US011766601B2

(12) United States Patent
Cappello et al.

(10) Patent No.: US 11,766,601 B2
(45) Date of Patent: Sep. 26, 2023

(54) SKATEBOARD WITH MULTI-WHEEL TRUCK

(71) Applicant: KARSTEN MANUFACTURING CORPORATION, Phoenix, AZ (US)

(72) Inventors: Dylan R. Cappello, Peoria, AZ (US); David L. Petersen, Peoria, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/538,864

(22) Filed: Nov. 30, 2021

(65) Prior Publication Data

US 2022/0080290 A1 Mar. 17, 2022

Related U.S. Application Data

(63) Continuation of application No. 16/826,630, filed on Mar. 23, 2020, now Pat. No. 11,185,757.

(60) Provisional application No. 62/880,562, filed on Jul. 30, 2019, provisional application No. 62/822,412, filed on Mar. 22, 2019.

(51) Int. Cl.
*A63C 17/01* (2006.01)

(52) U.S. Cl.
CPC ..... *A63C 17/014* (2013.01); *A63C 17/012* (2013.01)

(58) Field of Classification Search
CPC ..... A63C 17/014; A63C 17/04; A63C 17/012
See application file for complete search history.

(56) References Cited

U.S. PATENT DOCUMENTS

| | | | |
|---|---|---|---|
| 4,062,557 | A | 12/1977 | Roden |
| 4,337,961 | A | 7/1982 | Covert |
| 4,817,974 | A | 4/1989 | Bergeron |
| 4,911,456 | A | 3/1990 | Sarazen |
| 5,947,495 | A | 9/1999 | Null et al. |
| 6,158,753 | A | 12/2000 | Sturbaum |
| 6,431,568 | B1 | 8/2002 | McCleese |
| 8,608,185 | B2 | 12/2013 | Bermal |
| 8,807,577 | B2 | 8/2014 | Lai |
| D738,977 | S * | 9/2015 | Lai ..... D21/765 |
| 9,138,633 | B1 * | 9/2015 | Marusiak ..... A63C 17/014 |
| 9,492,731 | B2 | 11/2016 | Marusiak et al. |
| 9,573,045 | B2 | 2/2017 | Lai |
| 9,604,124 | B2 | 3/2017 | Aders |
| 2003/0141688 | A1 | 7/2003 | Lynn |
| 2010/0090423 | A1 | 4/2010 | Farrelly |
| 2013/0175777 | A1 | 7/2013 | Bermal |
| 2013/0181417 | A1 | 7/2013 | Smith |

(Continued)

FOREIGN PATENT DOCUMENTS

| | | |
|---|---|---|
| FR | 2766382 | 1/1999 |
| FR | 2810894 | 1/2002 |

(Continued)

OTHER PUBLICATIONS

PCT International Search Report and Written Opinion dated Jun. 22, 2020 from corresponding PCT Application No. PCT/US2020/024164.

*Primary Examiner* — Brian L Swenson

(57) ABSTRACT

A moving wheel platform that minimizes wheel interactions with noncontinuous and uneven surfaces. The platform provides rotation-inhibiting structures onto or into the moving wheel platforms that aids with eliminating wheel bite.

20 Claims, 16 Drawing Sheets

(56) References Cited

U.S. PATENT DOCUMENTS

| | | | |
|---|---|---|---|
| 2014/0197611 | A1 | 7/2014 | Lai |
| 2016/0074743 | A1 | 3/2016 | Marusiak et al. |
| 2016/0151699 | A1 | 6/2016 | Lai |
| 2018/0185738 | A1 | 7/2018 | Strand |

FOREIGN PATENT DOCUMENTS

| | | |
|---|---|---|
| KR | 20050060368 | 6/2005 |
| KR | 200390293 | 7/2005 |
| WO | 1998005390 | 2/1998 |
| WO | 2002020100 | 3/2002 |
| WO | 2003033089 | 4/2003 |
| WO | 2006061528 | 6/2006 |
| WO | 2009156528 | 12/2009 |

* cited by examiner

SKATEBOARD WITH MULTI-WHEEL TRUCK

RELATED APPLICATION DATA

This is a continuation of U.S. patent application Ser. No. 16/826,630, filed on Mar. 23, 2020, now U.S. Pat. No. 11,185,757, issued on Nov. 30, 2021, which claims the benefit of U.S. Patent Application No. 62/822,412, filed on Mar. 22, 2019 and U.S. Patent Application No. 62/880,562, filed on Jul. 30, 2019, the contents of all of which are entirely incorporated herein by reference.

TECHNICAL FIELD

This disclosure relates generally to skateboards and more particularly to a multi-wheel skateboard truck.

BACKGROUND

Individuals have ridden and used skateboards as a convenient and entertaining form of transportation. Generally, skateboards present many favorable advantages over other self-propelled transportation alternatives, as skateboards can be easily stored, picked up, and carried. However, and quite often, when users ride skateboards over cracks including (but not an exhaustive list of) contraction joints, expansion joints, control joints, and uneven surfaces, the wheels of the skateboard descend into the crack and then pop back up when the wheels of the skateboard contacts the other side of the crack. This type of interaction results in detrimental effects including, noise, shock to the rider, and handling (or control) of the skateboard. There is a need in the art for a moving wheel platform that minimizes wheel interactions with noncontinuous and uneven surfaces to enhance an individual's riding experience and satisfaction.

DESCRIPTION

Figure 1:
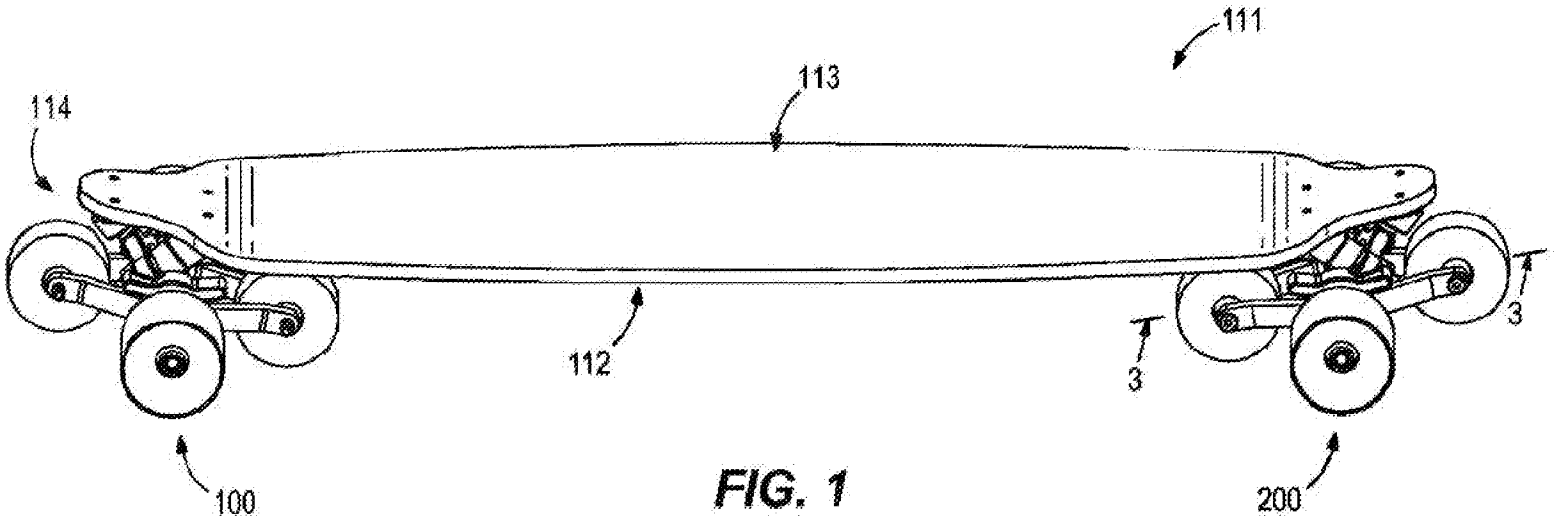
FIG. 1 shows a perspective view of a moving wheel platform coupled to a skateboard deck according to one embodiment.

The invention presented herein is directed to moving-wheel platforms that are capable of tempering negative (or unwanted) feedback experienced by a user when maneuvering over uneven surfaces, such as sidewalk cracks. Many of the moving-wheel platform embodiments presented herein, can be configured for use in skateboard or longboard applications (in the form of a truck). However, in alternative embodiments, the moving wheel platforms can be adapted for use in wheelbarrows, industrial carts, industrial dollies, commercial carts, commercial dollies, hand trucks, and stack trucks applications.

The skateboard or longboard can comprise a series of trucks having arms, axles and wheels arranged in such a manner that at least two wheels are in contact with the ground surface at any given moment, while another wheel of the truck is either suspended or submerged into a crack or voided space, when applicable. The truck is further configured to prevent the wheels of the truck from contacting or engaging the bottom of the skateboard or longboard when a sudden shift in the skateboard's center of mass occurs. This is at least in part accomplished by rotation inhibiting structures.

The term or phrase "connect", "connected", "connects", "connecting" used herein can be defined as joining two or more elements together, mechanically or otherwise. Connecting (whether mechanical or otherwise) can be for any length of time, e.g. permanent or semi-permanent or only for an instant.

The term or phrase "link", "linked", "links", "linking" used herein can be defined as a relationship between two or more elements where at least one elements affects another element. Linking (whether mechanical or otherwise) can be for any length of time, e.g. permanent or semi-permanent or only for an instant.

The term or phrase "secure", "secured", "secures", "securing" used herein can be defined as fixing or fastening (one or more elements) firmly so that it cannot be moved or become loose. Securing (whether mechanical or otherwise) can be for any length of time, e.g. permanent or semi-permanent or only for an instant.

The term or phrase "width" or "width of the elongated body" used herein is measured in a direction extending from a first end of the elongated body to a second end of the elongated body (or along the longitudinal axis of the elongated body), which is distal from the first end.

The term or phrase "couple", "coupled", "couples", and "coupling" used herein can be defined as connecting two or more elements, mechanically or otherwise. Coupling (whether mechanical or otherwise) can be for any length of time, e.g. permanent or semi-permanent or only for an instant. Mechanical coupling and the like should be broadly understood and include mechanical coupling of all types. The absence of the word "removably," "removable," and the like near the word "coupled," and the like does not mean that the coupling, in question is or is not removable.

The term or phrase "skateboard" or "longboard" used herein can be defined by four distinct portions. A top portion of the skateboard is defined as the portion of a deck the user stands on. A bottom portion of the skateboard is defined as the portion opposite the top portion. A stance of the right footed user by convention is defined as the left foot being forward of the right foot. A front portion of the skateboard is defined as being proximal to the left foot of the user. A back portion of the skateboard is defined as being proximal with the right foot of the user. A forward direction is defined as the direction when the right foot of the user pushes backwards on a ground surface to make the skateboard move in the opposite direction.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

In many examples as used herein, the term "approximately" can be used when comparing one or more values, ranges of values, relationships (e.g., position, orientation, etc.) or parameters (e.g., velocity, acceleration, mass, temperature, spin rate, spin direction, etc.) to one or more other values, ranges of values, or parameters, respectively, and/or when describing a condition (e.g., with respect to time), such as, for example, a condition of remaining constant with respect to time. In these examples, use of the word "approximately" can mean that the value(s), range(s) of values, relationship(s), parameter(s), or condition(s) are within ±0.5%, ±1.0%, ±2.0%, ±3.0%, ±5.0%, and/or ±10.0% of the related value(s), range(s) of values, relationship(s), parameter(s), or condition(s), as applicable.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Presented herein are skateboards or longboards comprising a series of trucks (skateboard 111, 511). The moving wheel platforms described herein can be configured for use in skateboard or longboard applications in the form of a truck (the truck 100, 200, 300, 400, 500). FIGS. 1-20 illustrates multiple truck embodiments that enables an apparatus to glide, hoover, and/or reduce adverse interactions between the skateboard truck and ground surface when the skateboard is moving over uneven surfaces, cracks, or joints. The various trucks (100, 200, 300, 400 or 500) comprises: a hanger having an elongated body, a pivot saddle protruding from the elongated body, one or more axle(s) extending through or partially through the elongated body, one or more arm(s) rotatably coupled (or connected) to the elongated body, and one or more rotation inhibiting structure(s) governing the rotation of the one or more arm(s). Further, a variety of wheel arrangements and rotation inhibiting structures are presented that cooperate together to approach voids present along riding surfaces differently. The various locations, arrangements, and configurations of the wheels, arms, and rotation inhibiting structures prevent the wheels from interacting, overextending and/or engaging the bottom surface of a skateboard or longboard.

I. Components of the Skateboard Truck

1. Hanger

In many of the exemplary skateboard truck embodiments, the truck comprises a hanger. The hanger generally comprises an elongated body; a pivot saddle protruding from the elongated body; a void (or bore) extending longitudinally through the elongated body; one or more arms pivotably (and/or removably) engaged to the hanger; and one or more rotation-inhibiting structure(s) configured to limit over rotation of the one or more arm(s). In many embodiments, the hanger is configured to be coupled to a baseplate.

The baseplate, in return, can be affixed to the bottom surface of the skateboard or longboard. As the hanger and the baseplate are assembled to one another, a linkage is formed that enables the hanger to become a base or foundation piece that directly or indirectly connects, links, or secures many of the undermentioned components together.

2. Elongated Body

Figure 2:
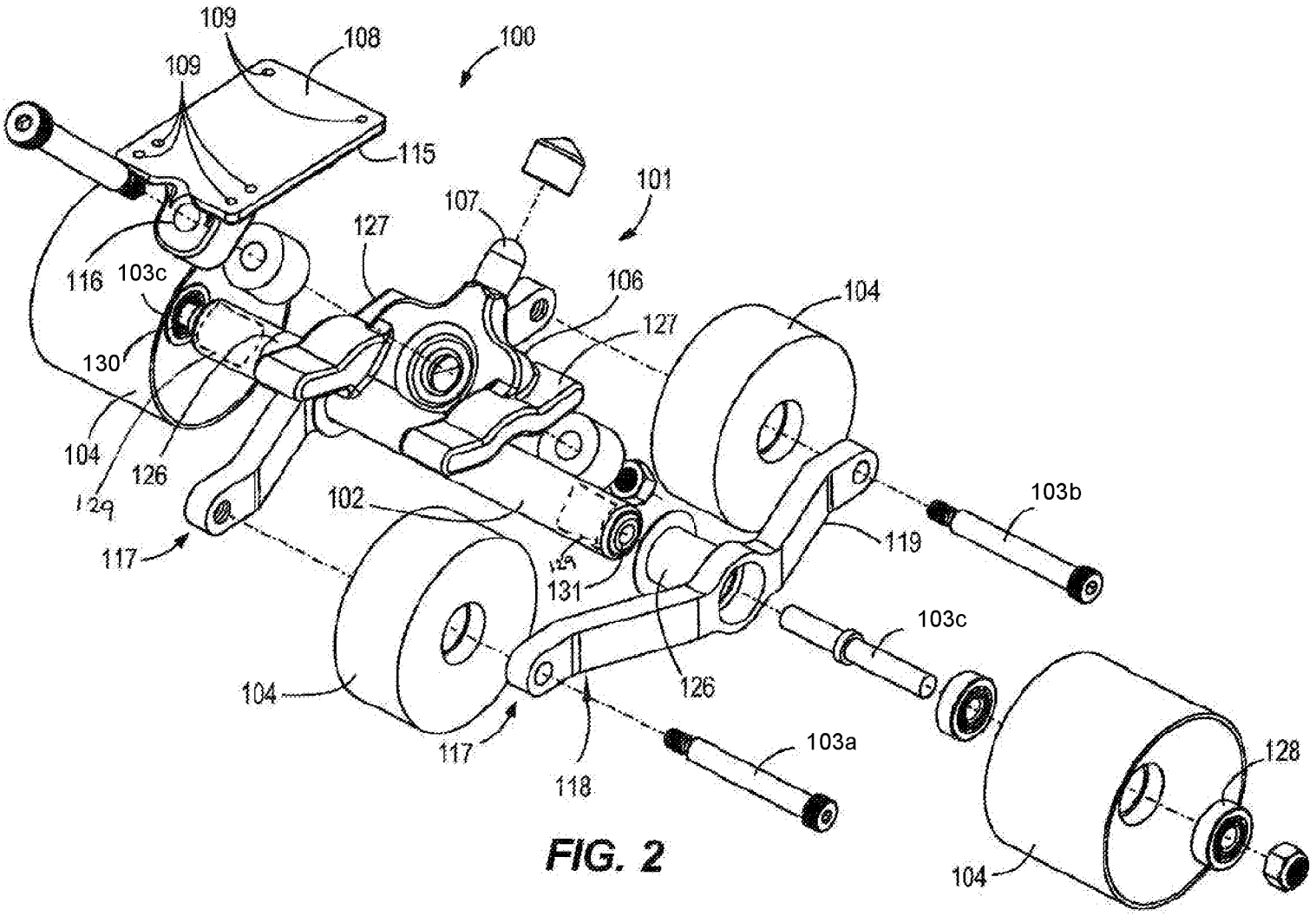
FIG. 2 shows a partial exploded view of the moving wheel platform of FIG. 1.

Generally, in many embodiments, a portion of the hanger comprises an elongated body. The elongated body of the hanger can be cylindrical ("elongated cylindrical body") and/or tubular ("elongated tubular body"). FIG. 2 illustrates a portion of an elongated body having a cylindrical portion. In this embodiment, the elongated cylindrical body can have a constant radius that extends in a first end to a second end direction of the elongated cylindrical body (i.e. along the longitudinal direction of the elongated body). The constant radius can range between 0.1 inch to 1 inch. In many embodiments, the constant radius can be 0.1-inch, 0.2-inch, 0.3-inch, 0.4-inch, 0.5-inch, 0.6-inch, 0.7-inch, 0.8-inch, 0.9-inch, or 1.0-inch. In other embodiments, the radius can be approximately between 0.1 inch-0.2 inch, 0.2 inch-0.3 inch, 0.3 inch-0.4 inch, 0.4 inch-0.5 inch, 0.5 inch-0.6 inch, 0.6 inch-0.7 inch, 0.7 inch-0.8 inch, 0.8 inch-0.9 inch, or 0.9 inch-1.0 inch. The radius of the elongated cylindrical body can vary to alter the mass properties of the skateboard truck.

Figure 8:
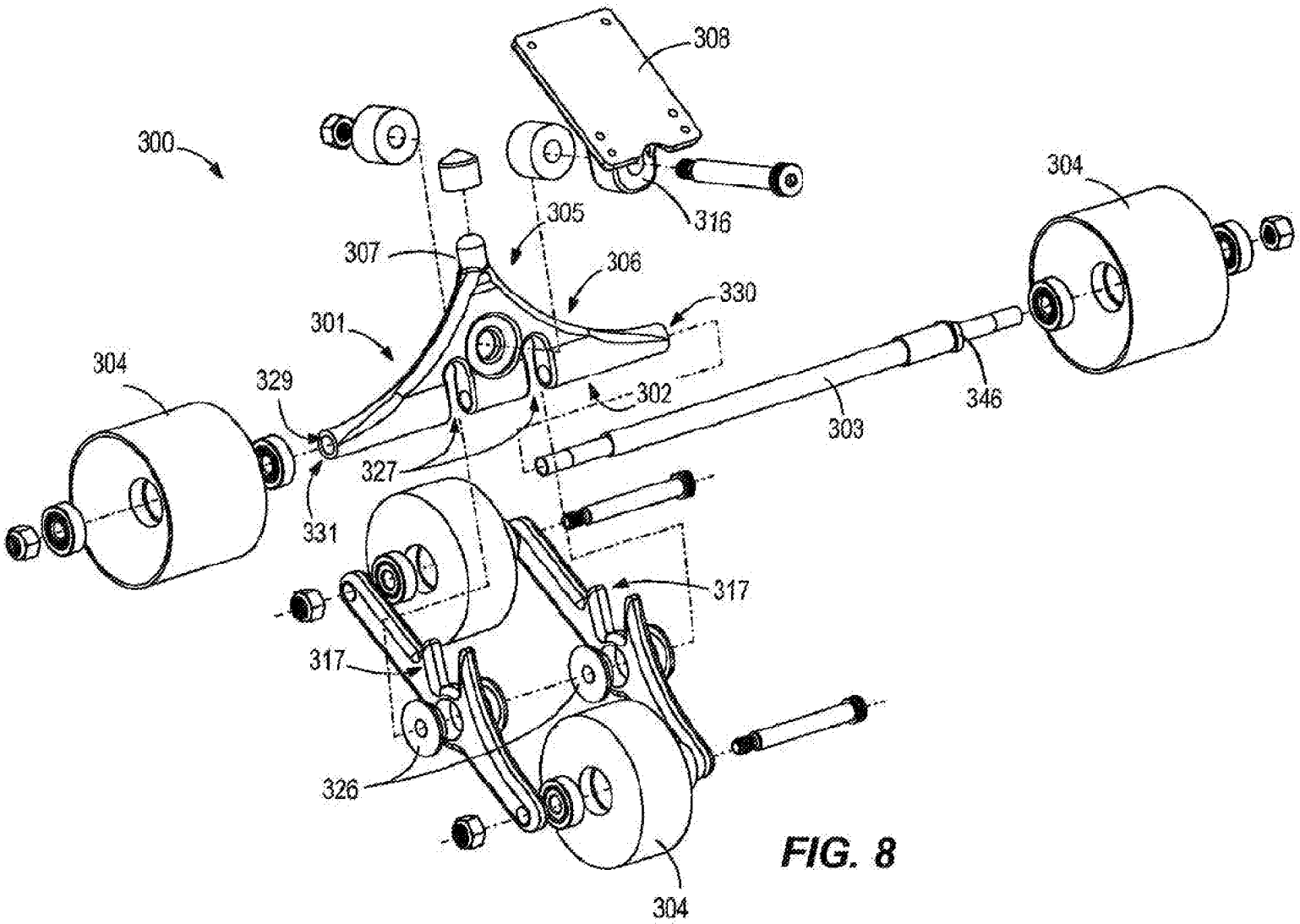
FIG. 8 shows an exploded view of a moving wheel platform according to another embodiment.

As previously mentioned, the elongated body can be tubular ("elongated tubular body"). In many embodiments, the elongated tubular body comprises an inner diameter and an outer diameter throughout the entire width of the hanger (see FIG. 8). FIG. 8 illustrates an elongated tubular member defined by an inner diameter D1 and an outer diameter D2. The inner diameter of the elongated tubular body can range between 0.01 inch to 0.55 inch.

In specific embodiments, the inner diameter D1 of the elongated tubular body can be 0.01 inch, 0.03 inch, 0.05 inch, 0.07 inch, 0.09 inch, 0.11 inch, 0.13 inch, 0.15 inch, 0.17 inch, 0.19 inch, 0.21 inch, 0.23 inch, 0.25 inch, 0.27 inch, 0.29 inch, 0.31 inch, 0.33 inch, 0.35 inch, 0.37 inch, 0.39 inch, 0.41 inch, 0.43 inch, 0.45 inch, 0.47 inch, 0.49 inch, 0.51 inch, 0.53 inch, or 0.55 inch. The outer diameter D2 can range between 0.1 inch to 1.0 inch. Specifically, the outer diameter of the elongated tubular body can be 0.1-inch, 0.2-inch, 0.3-inch, 0.4-inch, 0.5-inch, 0.6-inch, 0.7-inch, 0.8-inch, 0.9 inch, or 1.0 inch, or combinations thereof. In other embodiments, the outer diameter D2 can range between 0.1 inch-0.2 inch, 0.2 inch-0.3 inch, 0.3 inch-0.4 inch, 0.4 inch-0.5 inch, 0.5 inch-0.6 inch, 0.6 inch-0.7 inch, 0.7 inch-0.8 inch, 0.8 inch-0.9 inch, or 0.9 inch-1.0 inch.

The material of the elongated body can be constructed from any material used to construct a conventional skateboard truck. The elongated body of the hanger can be made from any one or combination of the following: 8620 alloy steel, S25C steel, carbon steel, maraging steel, 17-4 stainless steel, 1380 stainless steel, 303 stainless steel, stainless steel alloy, brushed steel, tungsten, titanium, titanium alloy, aluminum, aluminum alloy, aluminum 3003, aluminum 5052, aluminum 6061, aluminum 7075, Aluminum A356, ADC-12, or any other metal or plastic suitable for creating an elongated body. The material of the elongated body can vary based upon the intended use and/or weight of the hanger.

The elongated body of the hanger may vary in width to accommodate (or compliment) the width of the skateboard deck or a particular apparatus. In many embodiments, the width of the elongated body can range between approximately 5 inches to approximately 9 inches. In other embodiments, the width of the elongated body can be approximately between 5 inches-6 inches, 6 inches-7 inches, 7 inches-8 inches, or 8 inches-9 inches. In further embodiments, the width of the elongated body can approximately be 5 inches, 6 inches, 7 inches, 8 inches, 9 inches, or other suitable widths that enables a proper relationship between the width of the skateboard and the width of the hanger.

Figure 4:
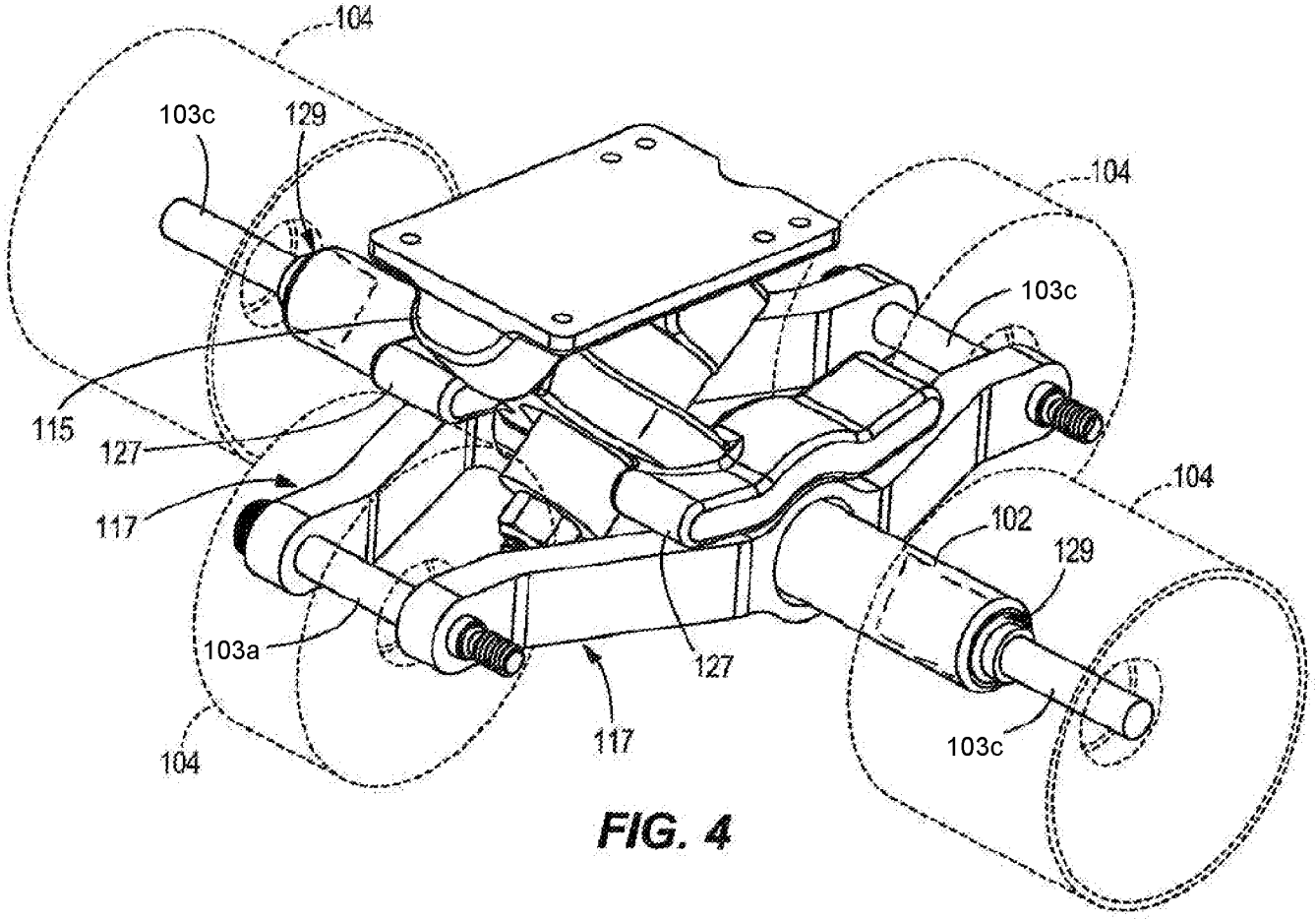
FIG. 4 shows an assembled moving wheel platform of FIG. 2.
Figure 5:
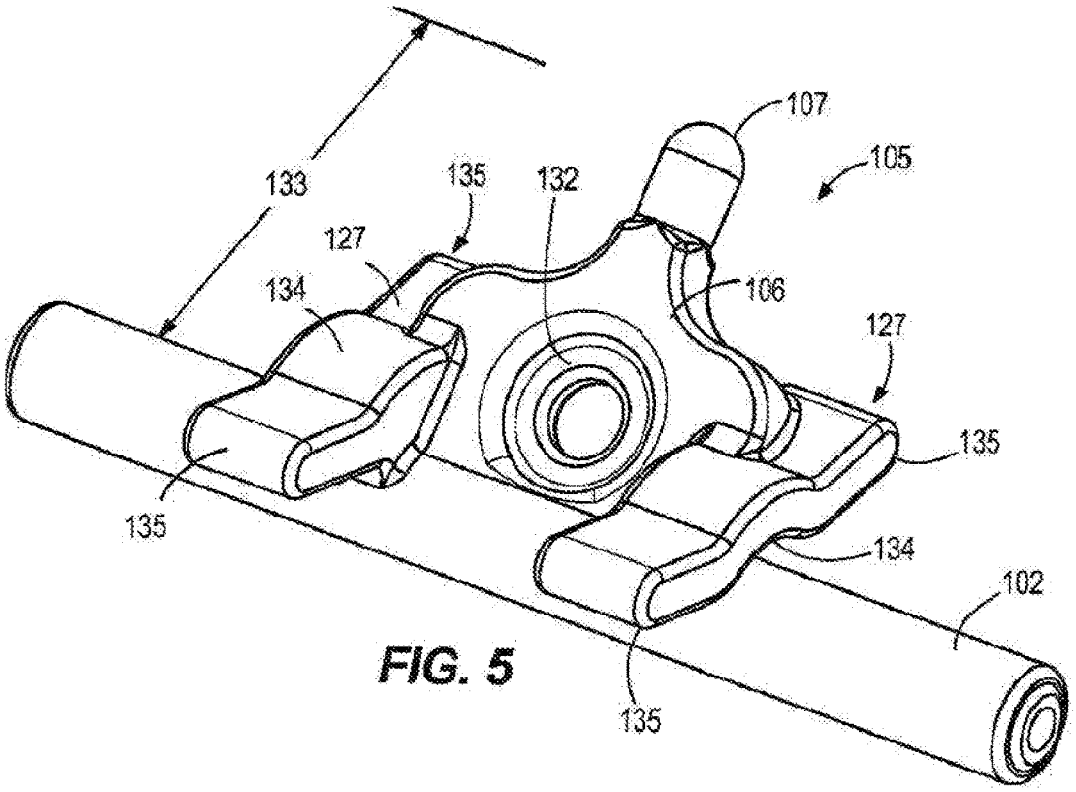
FIG. 5 shows a close up view of the hanger of FIG. 1.

In many embodiments, in a widthwise direction, a portion of the elongated body forms a void. An exemplary embodiment of the elongated body forming a void is illustrated in FIGS. 2 and 5. FIGS. 2 and 5 illustrates a void formed on each corresponding end (first end and second end) of the elongated body. Each void extends in a widthwise direction between approximately 1% and approximately 50% of the total width of the hanger. In other words, a portion of the elongated body surrounds a void as further illustrated by FIGS. 1-4, 9, and 10.

Each void of the elongated body can extend along the width direction of the elongated body between approximately 1% and 50%. Specifically, in many embodiments, the void can extend approximately between 1%-5%, 5%-10%, 10%-15%, 15%-20%, 20%-25%, 25%-30%, 30%-35%, 35%-40%, 40%-45%, or 45%-50% of the elongated body width. In alternative embodiments, as illustrated in FIGS. 8-19, the hanger can form a bore that extends entirely through the elongated body. The void or bore enables one or more axle(s) to become rigidly attached to the elongated body.

3. Axle(s)

The truck further comprises at least one axle. The one or more axles may extend either entirely through the elongated body of the hanger (if the elongated body forms a bore) or partially through the elongated body (if the elongated body forms a void). In many embodiments, if the bore extends entirely though the elongated body, then only one axle is needed. If a portion of the hanger is solid, then a void exists on the distal ends of the elongated body and two different axles extend through and out the ends of the elongated body. The void(s) can extend from each end of the elongated body into a percentage (less than approximately 50%) of the elongated body width, as a solid section of the elongated body exists between voids.

4. Wheels

The trucks further comprise at least two wheels. In many embodiments, one or more axles are configured to receive one or more wheels. Each of the one or more wheels may be characterized by a diameter (wheel diameter), a durometer (wheel durometer), and a material (wheel material). In many embodiments, the truck can have two or more wheels, three or more wheels, four or more wheels, five or more wheels, or six or more wheels. For further example, in many embodiments, the skateboard truck can have two wheels, three wheels, four wheels, five wheels, six wheels, or seven wheels.

In many embodiments, the diameter of the one or more wheel(s) ranges between 40 mm and 76 mm. In other embodiments, the wheel diameter can range between 40 mm-42 mm, 42 mm-44 mm, 44 mm-46 mm, 46 mm-48 mm, 48 mm-50 mm, 50 mm-52 mm, 52 mm-54 mm, 54 mm-56 mm, 56 mm-58 mm, 58 mm-60 mm, 60 mm-62 mm, 62 mm-64 mm, 64 mm-66 mm, 66 mm-68 mm, 68 mm-70 mm, 70 mm-72 mm, 72 mm-74 mm, or 74 mm-76 mm. In some embodiments, the wheel diameter of the one or more wheels can be 40 mm, 41 mm, 42 mm, 43 mm, 44 mm, 45 mm, 46 mm, 47 mm, 48 mm, 49 mm, 50 mm, 51 mm, 52 mm, 53 mm, 54 mm, 55 mm, 56 mm, 57 mm, 58 mm, 59 mm, 60 mm, 61 mm, 62 mm, 63 mm, 64 mm, 65 mm, 66 mm, 67 mm, 68 mm, 69 mm, 70 mm, 71 mm, 72 mm, 73 mm, 74 mm, 75 mm, or 76 mm.

One or more wheel(s) may have an equivalent and/or similar diameter with respect to another wheel, two or more wheels, three or more wheels, four or more wheels, or five or more wheels. In alternative embodiments, one or more wheels may have a different wheel diameter with respect to another wheel, two or more wheels, three or more wheels, four or more wheels, or five or more wheels.

In many embodiments, the wheel durometer can vary based upon the intended use of the wheel and desired gripping ability with the ground surface. For example, if the user (or individual) requires wheels that provide enough grip to maneuver over rough surfaces, sidewalk contraction joints, cracks, pebbles, rocks, etc., then the durometer of the plurality of wheels may range between approximately 78a-98a. In other embodiments, the wheel durometer value can be between approximately 78a-80a, 80a-82a, 82a-84a, 84a-86a, 86a 88a, 88a-90a, 90a-92a, 92a-94a, 94a-96a, or 96a-98a. In some embodiments, the wheel durometer value can be 78a, 79a, 80a, 81a, 82a, 83a, 84a, 85a, 86a, 87a, 88a, 89a, 90a, 91a, 92a, 93a, 94a, 95a, 96a, 97a, or 98a. To achieve a desired wheel durometer, the plurality of wheels can be formed from various plastic or plastic polyurethane materials.

5. Wheel Bearings

Each of the plurality of wheels further includes a wheel bearing set. In many of the illustrative embodiments, a center of each of the plurality of wheels forms a cutout portion to accommodate the wheel bearing set. The wheel bearing set reduces or eliminates friction between the plurality of wheels and the axle the wheel rotates about. The cut-out portion can be substantially round or circular, however, in alternative embodiments the cut out-portion can be any geometry that permits rotation. In many exemplary embodiments, the wheel bearing set can be in the form of a steel bearing set or a ceramic bearing set.

6. Pivot Saddle

In many embodiments, the hanger further comprises a pivot saddle that extends from the elongated body. The pivot saddle enables a user to alter the direction of the truck. For example, the pivot saddle provides the ability to pivot the truck in a left or right direction. The pivot saddle comprises a pivot tip and a pivot body. In general, and more preferably, the pivot saddle can be integrally connected to the elongated body and therefore formed as one component. In other embodiments, the pivot saddle and the elongated body can be formed from a similar or different material. The combination of the elongated body and pivot saddle generally outlines a triangular shape. The pivot saddle connects and engages to a base plate.

In many embodiments, the pivot saddle is centrally located along the elongated body relative to the first and second ends. In alternative embodiments, the pivot saddle can be asymmetrically positioned along the elongated body. In many embodiments, the pivot saddle can be located between approximately 20% and approximately 80% of the total width of the elongated body (measured from either the first end or the second end of the elongated body of the hanger). For example, the pivot saddle can be positioned approximately 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, or 55% away from either the first end and/or second end of the elongated body.

In many embodiments, the pivot body alone can take the form of a substantially triangular shape, as shown in some of the below exemplary embodiments. In alternative embodiments, the pivot body can be substantially square, rectangular, curvilinear, semi-circular, parabolic, or combinations thereof.

In many embodiments, the pivot body forms a through aperture (pivot body aperture). In general, the geometry of the through aperture is circular or cylindrical. However, in other embodiments, the geometry of the through aperture can be of an oval, elliptical, round, or countersunk form.

The material of the pivot body can be constructed from any material used to construct a conventional skateboard truck. The pivot body of the pivot saddle can be made from any one or combination of the following: 8620 alloy steel, S25C steel, carbon steel, maraging steel, 17-4 stainless steel, 1380 stainless steel, 303 stainless steel, stainless steel alloy, brushed steel, tungsten, titanium, titanium alloy, aluminum, aluminum alloy, aluminum 3003, aluminum 5052, aluminum 6061, aluminum 7075, ADC-12, Aluminum A356, or any other metal suitable for creating a pivot body. In many embodiments, the pivot body is made of aluminum 6061 or the cast equivalent. The material of the pivot body can vary based upon the intended use and/or desired weight of the pivot saddle.

The pivot tip of the pivot saddle engages a pivot cup of the base plate. Combining the pivot tip and the pivot body together forms a pivot saddle that permits the truck to maneuver in both a left and/or right direction. The pivot tip can be integrally formed to the pivot body, thereby forming a single continuous structure.

In many embodiments, the pivot tip is widest at the surface adjacent to the pivot body and as the pivot tip becomes spaced further from the adjacent surface, the pivot tip gradually tapers (i.e. decreases in width as a function of increasing distance from the adjacent surface). At the distal most point from the adjacent surface, the pivot tip is substantially pointed and/or tipped. The arrangement and interaction of the pivot saddle and pivot cup will be described in more detail below.

The material of the pivot tip can be constructed from any material used to construct a conventional skateboard truck. The pivot tip of the pivot saddle can be made from any one or combination of the following: 8620 alloy steel, S25C steel, carbon steel, maraging steel, 17-4 stainless steel, 1380 stainless steel, 303 stainless steel, stainless steel alloy, brushed steel, tungsten, titanium, titanium alloy, aluminum, aluminum alloy, aluminum 3003, aluminum 5052, aluminum 6061, aluminum 7075 ADC-12, Aluminum A356, or any metal suitable for creating a pivot tip. In many embodiments, the pivot tip can be made of aluminum 6061 or the cast equivalent. The material of the pivot tip can vary based upon the intended use and/or desired weight of the pivot saddle.

7. Base Plate

The base plate, as previously described, is configured to receive a portion of the hanger and more particularly a portion of the pivot saddle. In many embodiments, the pivot tip of the pivot saddle protrudes from the elongated body of the hanger to engage a portion of the base plate. Thereby, affixing the hanger and the base plate together. The base plate can be defined as the component of the moving wheel platform (or truck) that couples, connects, attaches, and/or links the elongated body, the plurality of wheels, and the pivot saddle to a given apparatus to create a "movable apparatus".

The base plate forms a plurality of bolt receiving ports, at least one king pin receiving port, and at least one pivot cup receiving port. These receiving ports provide receiving geometries for a plurality of bolts, a king pin, and the pivot tip of the pivot saddle, respectively. Thereby, securing the moving wheel platform or the truck to a given apparatus.

In many embodiments, the plurality of bolt receiving ports (of the base plate) are proximal to the outer periphery or outer perimeter edge of the base plate. Further, in many embodiments, the plurality of bolt receiving ports are threaded ("threaded bolt receiving ports"). The geometrical characteristics of the threaded bolt receiving ports can vary (i.e. thread type, thread count, pitch, etc.) based upon the geometrical characteristics of a corresponding fastener configured to be received within the threaded bolt receiving ports.

For example, and by way of nonlimiting examples, the base plate can have two bolt receiving ports, three bolt receiving ports, four bolt receiving ports, five bolt receiving ports, six bolt receiving ports, or seven bolt receiving ports. As will be seen and further described below, the base plate can comprise at least four bolt receiving ports. This provides enough structural rigidity to affix the base plate to a given apparatus (i.e. affixing a skateboard truck to a skateboard deck).

The king pin receiving aperture (of the base plate) can be centrally located on the base plate with respect to the perimeter walls of the base plate. In many embodiments, the king pin receiving aperture may or may not be threaded. The geometrical characteristics of the king pin receiving aperture can vary (i.e. thread type, thread count, pitch, etc.) based upon the type and geometry of the king pin. As will be seen and further described in the below embodiments, the king pin receiving aperture can be located forward of the base plate's pivot cup. In many embodiments, the king pin can be a hollow screw that connects the elongated hollow body and the pivot saddle together (at the aperture of the pivot body) to the base plate. This arrangement couples the elongated hollow body and pivot saddle to the base plate.

The material of the base plate can be constructed from any material used to construct a conventional skateboard truck. The base plate can be made from any one or combination of the following: 8620 alloy steel, S25C steel, carbon steel, maraging steel, 17-4 stainless steel, 1380 stainless steel, 303 stainless steel, stainless steel alloy, brushed steel, tungsten, titanium, titanium alloy, aluminum, aluminum alloy, aluminum 3003, aluminum 5052, aluminum 6061, aluminum 7075 ADC-12, Aluminum A356, or any metal suitable for creating a base plate. In many embodiments, the base plate is made of aluminum 6061. The material of the base plate can vary based upon the intended use and/or desired weight of the base plate.

8. Pivot Cup Bushing

The pivot cup receiving port (of the base plate) can be centrally located on the base plate with respect to the perimeter walls (of the base plate). In many embodiments, the pivot cup receiving port can be configured to receive a pivot cup bushing. The pivot cup bushing is generally comprised of a different material then the pivot cup receiving port. For example, in many embodiments, the pivot cup bushing can be comprised of a plastic, polyurethane, or Delrin material. As will be seen in the below embodiments, the pivot cup receiving port can be located rearward of the base plate's king pin receiving aperture.

The pivot tip of the pivot saddle can be configured to be received in the pivot cup bushing, and likewise the pivot cup bushing is configured to be received within the pivot cup receiving port. The combination of the pivot tip, the pivot cup bushing, and the pivot cup receiving port enables less metal-to-metal friction and the ability to more effectively pivot, turn, and/or alter the skateboard truck in different directions.

9. Arms

The hanger further comprises one or more arms that are rotatably coupled to the elongated body of the hanger. In many of the illustrated embodiments, the one or more arm(s) can be on opposing sides of the pivot saddle, or alternatively the pivot saddle in combination with the one or more arm(s) can create a backstop. Thereby, establishing a mechanical lock to prevent overextension or over rotation of the one or more arm(s).

The one or more arm(s) includes a first segment and a second segment. The first segment can be considered as the leading segment and is forward of the second segment ("rear segment"). The second segment can also be considered as the trailing segment and is rearward of the first segment. In many embodiments, as illustrated by FIGS. 1-4, the first segment can be a similar or equivalent length to the second segment. In other embodiments, the first segment can be between 15% and 35% longer in length than the second segment. In further embodiments, the first segment can be between 15%-17%, 17%-19%, 19%-21%, 21%-23%, 23%-25%, 25%-27%, 27%-29%, 29%-31%, 31%-33%, and 33%-35% longer in length relative to the second segment. In many embodiments, the first segment can be 15%, 16%, 17%, 18%, 19%, 20%, 21%, 22%, 23%, 24%, 25%, 26%, 27%, 28%, 29%, 30%, 31%, 32%, 33%, 34%, or 35% longer in length than the second segment.

The first segment and second segment of the one or more arms can form together to be substantially coplanar with one another. In other embodiments, the first segment and the second segment can be angled relative to one another between 160 degrees and 180 degrees. For example, in some embodiments, the angle between the first segment and the second segment can be approximately between 160 degrees-165 degrees, 165 degrees-170 degrees, 170 degrees-175 degrees, or 175 degrees-180 degrees. In alternative embodiments, the angle between the first segment and the second segment can be 160 degrees, 161 degrees, 162 degrees, 163 degrees, 164 degrees, 165 degrees, 166 degrees, 167 degrees, 168 degrees, 169 degrees, 170 degrees, 171 degrees, 172 degrees, 173 degrees, 174 degrees, 175 degrees, 176 degrees, 177 degrees, 178 degrees, 179 degrees, or 180 degrees.

The one or more arms can further comprise a front region, which can be similar to the first segment, a rear region, which can be similar to the second segment, and a middle region which is in between the first segment and the second segment. The front region forms a first aperture (also known as a "front aperture"). The middle region forms a second aperture (also known as a "middle aperture"). The rear region forms a third aperture (also known as a "rear aperture"). The aperture can be in the form of a through aperture, a bore aperture, a cylindrical aperture, and/or a circular aperture. The diameter of the first aperture ("front aperture"), second aperture ("middle aperture"), and third aperture ("rear aperture") can be equivalent to one another or different from one another.

The diameter of the front aperture, the middle aperture, and the rear aperture can range between 0.25 inch to 1.01 inches. In many embodiments, the front aperture, the middle aperture, and the rear aperture can be range between 0.25 inch-0.27 inch, 0.27 inch-0.29 inch, 0.29 inch-0.31 inch, 0.31 inch-0.33 inch, 0.33 inch-0.35 inch, 0.35 inch-0.37 inch, 0.37 inch-0.39 inch, 0.39 inch-0.41 inch, 0.41 inch-0.43 inch, 0.43 inch-0.45 inch, 0.45 inch-0.47 inch, 0.47 inch-0.49 inch, 0.49 inch-0.51 inch, 0.51 inch-0.53 inch, 0.53 inch 0.55 inch, 0.55 inch-0.57 inch, 0.57 inch-0.59 inch, 0.59 inch-0.61 inch, 0.61 inch-0.63 inch, 0.63 inch-0.65 inch, 0.65 inch-0.67 inch, 0.67 inch-0.69 inch, 0.69 inch-0.71 inch, 0.71 inch-0.73 inch, 0.73 inch-0.75 inch, 0.75 inch-0.77 inch, 0.77 inch-0.79 inch, 0.79 inch-0.81 inch, 0.81 inch-0.83 inch, 0.83 inch-0.85 inch, 0.85 inch-0.87 inch, 0.87 inch-0.89 inch, 0.89 inch-0.91 inch, 0.91 inch-0.93 inch, 0.93 inch-0.95 inch, 0.95 inch 0.97 inch, 0.97 inch-0.99 inch, or 0.99 inch-1.01 inch. In specific embodiments, the front aperture, the middle aperture, and the rear aperture can be approximately 0.25-inch, approximately 0.30-inch, approximately 0.35-inch, approximately 0.40-inch, approximately 0.45-inch, or approximately 0.50-inch.

The front aperture of one or more arms can be configured to receive a front axle and a corresponding front wheel. The rear aperture of the one or more arms can be configured to receive a rear axle and a corresponding rear wheel. The middle aperture of the one or more arms can be configured to concentrically attach, link, and/or couple to the elongated body of the hanger. This concentrical linkage between the middle aperture of the one or more arms and the elongated body of the hanger creates a lever arm, which can also be referred to as a pivot arm. Thereby, allowing the one or more arms to rotate and/or pivot relative to the elongated body.

As mentioned above, the level arm (or "pivot arm") rotates about the elongated body. This type of rotation and/or pivot enables the front wheel and/or rear wheels to climb or glide over foreign object debris, such as sidewall contraction joints, pebbles, small rocks, uneven surfaces, or other debris that may be residing on a ground surface. Some of the benefits and advantages of the level arm will further be discussed in the benefits section.

10. Rotation-Inhibiting Structure

The truck further can comprise one or more rotation-inhibiting structure(s). The rotation inhibiting structure prevents the level arm (or pivot arm) from excessively rotating past a predetermined angle. The rotation inhibiting structure may be in a variety of forms. For example, in one embodiment the rotation inhibiting structure may integrally protrude or extend from a truck component (i.e. a pivot body). In another embodiment, a truck component can form a rotation inhibiting structure, which can take the form of a notch, gap, slot, or slit. The rotation inhibiting structure beneficially prevents the level arm or pivot arm from excessive rotation to the point where either the front wheel or the rear wheel contacts a bottom surface of the skateboard deck during engagement of the skateboard or longboard.

In one exemplary embodiment, when the front wheel and the rear wheel of the level arm or pivot arm resides on a ground surface, the rotation inhibiting structure prevents the front end and rear end of the pivot arm from upwardly rotating past 50 degrees. In other embodiments, the rotation inhibiting structure may prevent the front end and the rear end of the pivot arm from upwardly rotating past 45 degrees, 40 degrees, 35 degrees, 30 degrees, 25 degrees, 20 degrees, 15 degrees, 10 degrees, or 5 degrees. In alternative embodiments, the predetermined range of motion for the front end and rear end of the level arm (or pivot arm) can be approximately between 0 degrees and 45 degrees, 0 degrees and 40 degrees, 0 degrees and 35 degrees, 0 degrees and 30 degrees, 0 degrees and 25 degrees, 0 degrees and 20 degrees, 0 degrees and 15 degrees, 0 degrees and 10 degrees, or 0 degrees and 5 degrees.

A 0-degree reference angle is defined as the position where both the front wheel and the rear wheel of the level arm or pivot arm reside on a substantially flat ground surface. As the pivot arm beings to upwardly rotate (i.e. the perpendicular distance between the front wheel or rear wheel relative to the bottom surface of the skateboard deck is shorter than the perpendicular distance between the front wheel and rear wheel at a rest position (on a substantially flat ground surface) relative to the bottom surface of the skateboard deck. The effect of the rotation inhibiting structure is present when the pivot arm or level arm reaches a predetermined rotation threshold angle.

11. Friction Reducing Element

In many exemplary embodiments, the truck preferably comprises a friction reducing element. In general, the friction reducing element is a component between the elongated body of the hanger and the one or more of the arms (also can be defined as the medium between the middle aperture of the one or more arm(s) and the elongated body). The friction reducing element reduces the magnitude of frictional forces between the elongated body of the hanger and the one or more arms. Specifically, in many embodiments, the friction reducing element prevents material galling. In alternative embodiments, the friction reducing element can be in the form of a flange. In other embodiments, the friction reducing element can be cylindrical, round, circular, or tubular to compliment the shape of the middle aperture of the one or more arms.

The friction reducing element can be made from any one or combination of the following: nylon, PVC, polythene, polypropylene, or any plastic suitable for reducing friction between two materials. In some embodiments, the friction reducing element is comprised of a nylon material.

I. Benefits

The moving wheel platform described herein beneficially provides enhancements in self-propelled equipment or self-propelled apparatuses. In particular, by creating a moving wheel platform ("skateboard truck" or "truck") that when fully assembled ("truck assembly") comprises a rotation inhibiting structure and a pivot/lever arm, the truck assembly effectively maneuvers over foreign objects, such as, but not an exclusive list of sidewalks contraction joints, pebbles, rocks, cracks, or similar objects that creates interference between the wheels and the ground surface (when the self-propelled apparatus is in motion).

In many embodiments, the moving wheel platform (or the skateboard truck) comprises four or more wheels. These wheels can be arranged in a diamond shape configuration. The first and second wheels (two of the four wheels) can be attached to each end of the elongated body. The third and fourth wheels (other two wheels of the four wheels) can be attached to the front segment and rear segment of the one or more pivot/level arm(s). This type of wheel arrangement equally distributes forces loaded onto the truck to create a balanced truck that more effectively glides and/or climbs over sidewalk contraction joints and/or other type of surface cracks. This beneficially prevents (or reduces) the plurality of wheels of the moving wheel platform from entering (or reducing the degree of decent with) sidewalk contraction joints or cracks. Thereby preventing the wheels engaging or getting caught within the sidewalk contraction joint or surface cracks. Thus, eliminating or greatly reducing the possibility of the individual potentially losing balance and/or momentum.

Another beneficial aspect of the moving wheel platform described herein is to have one or more arms concentrically, pivotably, and/or rotatably engaged to the elongated body of the hanger. By having one or more arms rotatable or pivotable about the elongated body of the hanger enables the front segment or the trailing segment at any given moment to upwardly rotate away from the ground surface. For example, the one or more arms that are concentrically and pivotally connected to the elongated body of the hanger may rotate based upon a shift in the skateboard's center of mass (i.e. the mass of the rider being repositioned on the skateboard deck caused by a slope, turn, etc).

Another beneficial aspect of the moving wheel platform described herein is to have one or more rotation inhibiting structures. Integrating rotation inhibiting structures into the moving wheel platform or truck mechanically prevents over-rotation of the one or more pivot arms past a predetermined degree of rotation. This beneficially prevents the plurality of wheels positioned on the first segment and/or trailing segment from inadvertent contact with the bottom portion of a skateboard deck.

Another beneficial aspect of the moving wheel platform described herein is to have at least one friction reducing element. The friction reducing element can be positioned between the middle aperture of the one or more arms and the elongated body of the hanger. The friction reducing element beneficially reduces frictional forces between the cylindrical body of the hanger and the one or more arms. Additionally, the friction reducing element can prevent material galling between the one or more arms and the elongated body of the hanger.

II. Embodiments

At least some exemplary embodiments of a moving wheel platform according to this invention are described herein, including skateboard trucks and longboard trucks. Such apparatus may include all or some of the aforementioned components, features, and benefits.

Skateboard Truck I

FIGS. 1-7 illustrates an embodiment of a moving wheel platform (or truck). The truck described herein comprises an elongated body having a pivot saddle protruding (or extending) therefrom. The pivot saddle 105 is configured to have one or more rotation inhibiting structure(s) 127 protruding (or extending) outwardly towards the first end 130 and/or second end 131 of the elongated body 102. The one or more rotation inhibiting structure(s) 127 can be adjacent and on opposing sides of the pivot saddle and spaced from the elongated body 102. The spaced formed between the one or more rotation inhibiting structure(s) 127 can be adapted to receive a complimentary middle region geometry (with respect to the rotation inhibiting structure) of the one or more arm(s) 117.

Figure 3:
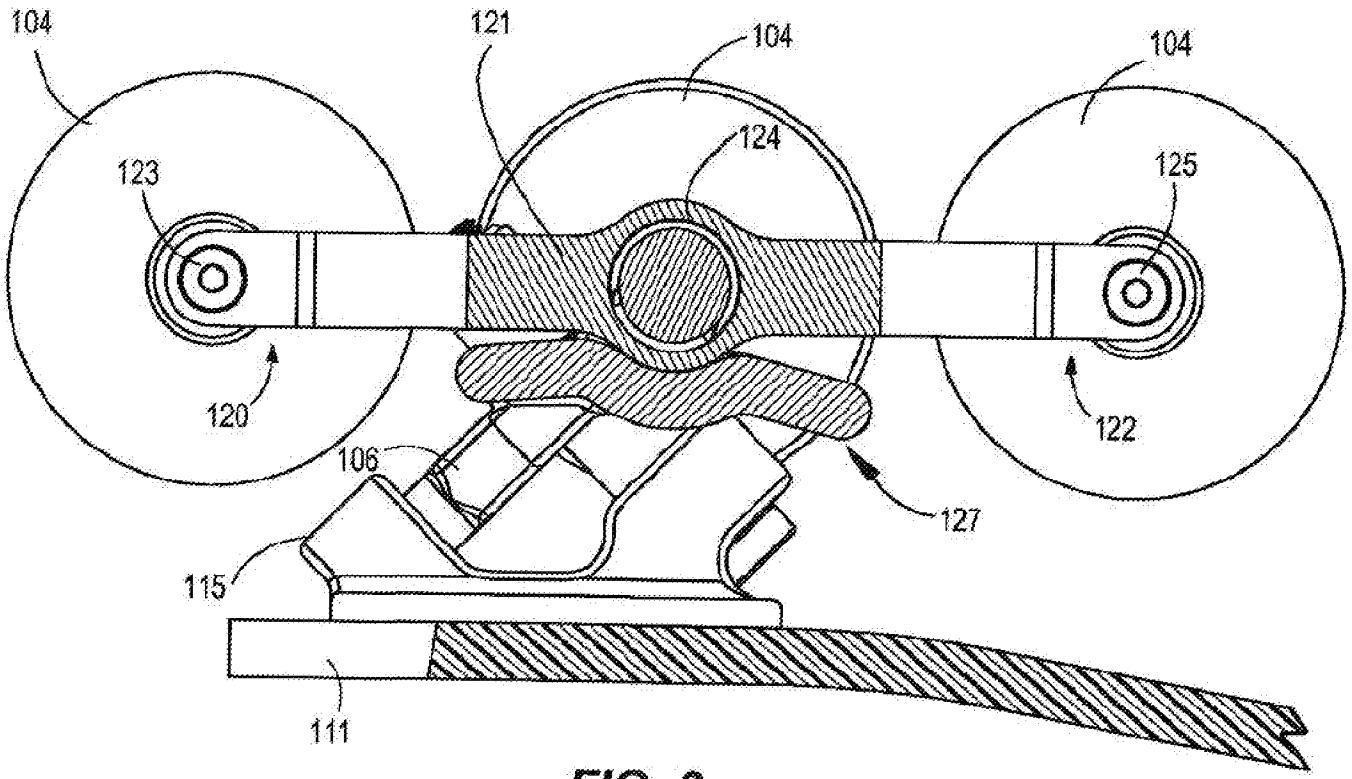
FIG. 3 shows another perspective view of a moving wheel platform coupled to a skateboard of FIG. 1.
Figure 6:
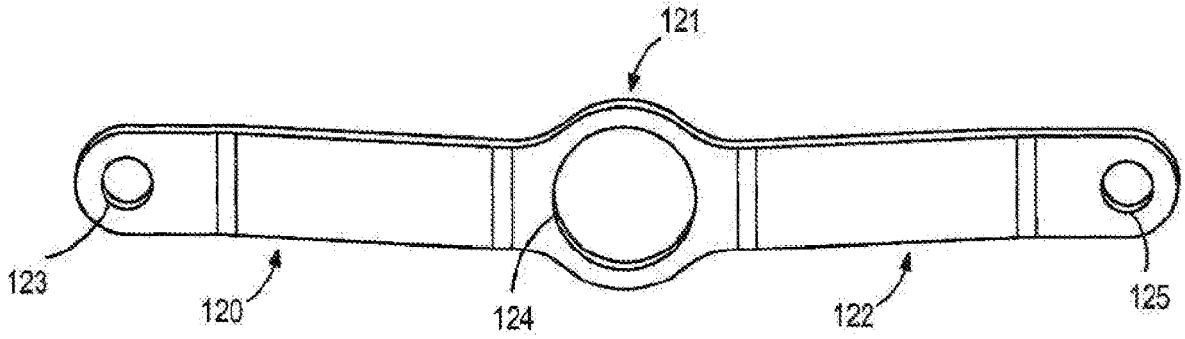
FIG. 6 shows a close-up view of the arm of FIG. 1.
Figure 7:
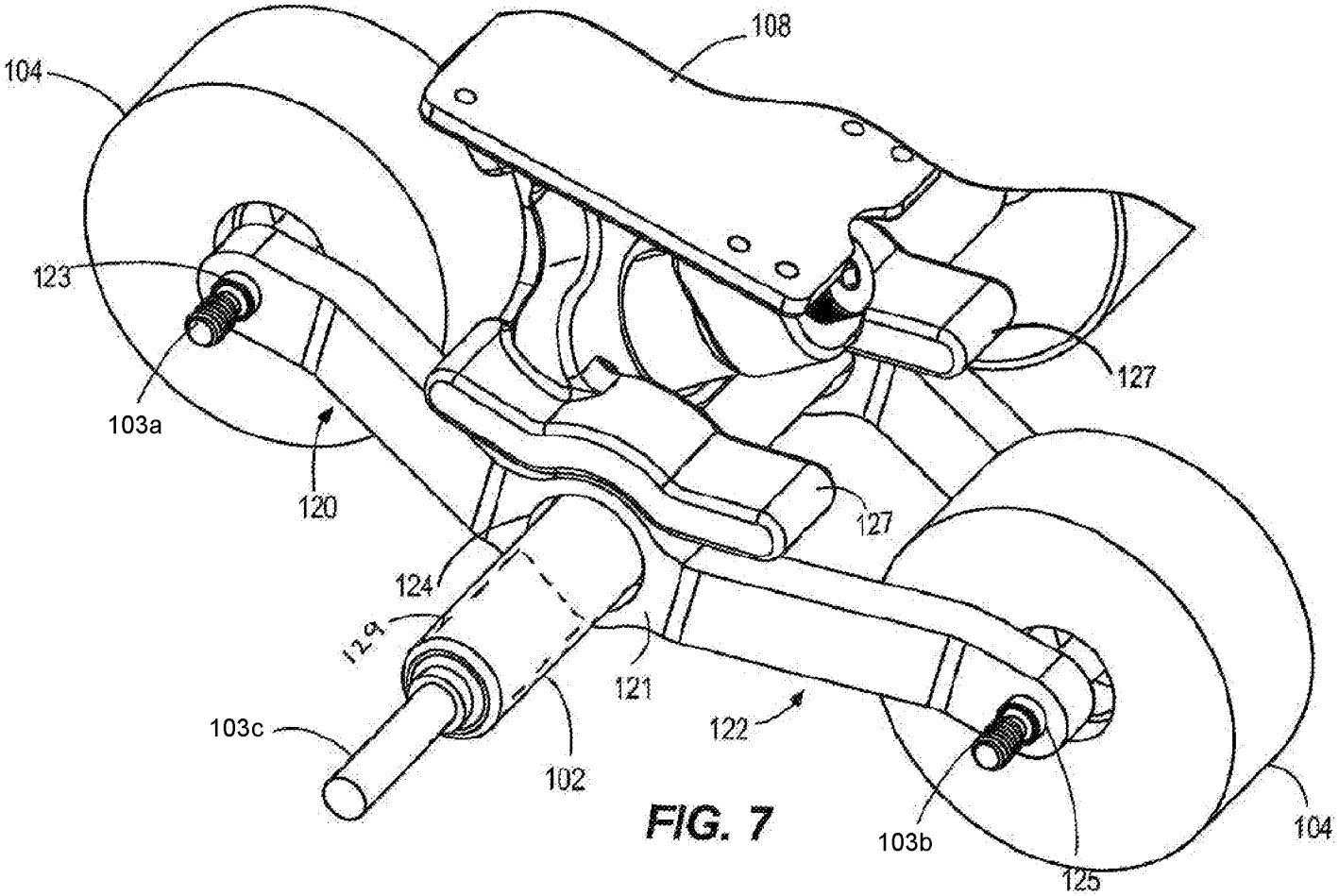
FIG. 7 shows a partial assembled view of FIG. 4.

Specifically, FIG. 1 illustrates a moving wheel platform in the form of a skateboard truck 100. FIG. 2 illustrates a partial exploded view of the skateboard truck of FIG. 1. FIG. 3 illustrates a zoomed in view of the skateboard truck of FIG. 1. FIG. 4 illustrates a partial assembly of the skateboard truck of FIG. 1. FIGS. 5 and 6 each illustrate an individual truck component of a hanger and an arm, respectively. FIG. 7 illustrates another perspective view of FIG. 3.

FIG. 1 illustrates an example of a skateboard truck to be ridden by a rider (not shown). The rider has a weight (i.e. without limitation, helmet, wrist guards, elbow pads, and knee pads, as appropriate, and anything else the rider is carrying or supporting such as a backpack).

Continuing reference to FIG. 1, the truck 100 is attached to a bottom surface 112 of the skateboard deck 111. The skateboard deck 111 includes a top surface 113 to support the rider (not shown). In this embodiment, the skateboard includes a front truck 100 and a rear truck 200. The front truck and the rear truck share similar components and designs. The front truck 100 can be attached to the bottom surface 112 of the skateboard deck 111 at a front portion 114 of the skateboard deck. The rear truck 200 can be attached to the bottom surface 112 of the skateboard deck 111 at a rear portion of the skateboard deck 111.

FIGS. 1 and 4 further illustrates an assembled arrangement of the above described components to form the front truck 100 and the rear truck 200. In this exemplary embodiment, the components of the front truck 100 and the rear truck 200 include a hanger 101 having an elongated body 102 and a pivot saddle 105 (which comprises a pivot body 106 and a pivot tip 107), at least four axles 103*a*, 103*b*, 103*c*, a base plate 108, at least two arms 117, at least two rotation inhibiting structures 127, and at least two friction reducing elements 126.

I. Elongated Body

The elongated body 102 can be sized to be approximately the width of the skateboard deck 111 shown in FIG. 1 (which is also illustrated in FIGS. 4 and 5). As previously described above, the width of the elongated body 102 can range between approximately 4 inches to approximately 10 inches. In particular, the width of the elongated body 102 can be approximately 4 inches, approximately 5 inches, approximately 6 inches, approximately 7 inches, approximately 8 inches, approximately 9 inches, or approximately 10 inches. In alternative embodiments, the width of the elongated body 102 can be approximately 4 inches—approximately 5 inches, approximately 5 inches—approximately 6 inches, approximately 6 inches—approximately 7 inches, approximately 7 inches—approximately 8 inches, approximately 8 inches—approximately 9 inches, or approximately 9 inches—approximately 10 inches. In this embodiment, the width of the elongated body 102 can be approximately 7 inches.

The elongated body 102 forms a void 129 that extends from and partially through both the first end 130 and the second end 131 of the elongated body 102. As described above, the void 129 of the elongated body extends between 5% and 45% of the elongated body width on each end (i.e. the first end 130 and the second end 131) of the corresponding elongated body end. For example, the void can extend through each end of the elongated body 102 between 5%, 10%, 15%, 20%, 25%, 30%, 35%, 40%, or 45% of the width of the elongated body. In other embodiments, the void can extend through each end (the first end and the second end) of the elongated body 102 between approximately 1%-5%, 5%-10%, 10%-15%, 15%-20%, 20%-25%, 25%-30%, 30%-35%, 35%-40%, or 40%-45%. In alternative embodiments, the void can extend through each end of the elongated body at a distance less than the total width of the elongated body 102. In this illustrative example, each void formed partially by the first end 130 and the second end 131 extends approximately 20% of the width of the elongated body 102.

a. Axle(s)

The truck 100 comprises a plurality of axels 103*a*, 103*b*, 103*c*. In the embodiment illustrated in the FIG. 2, the truck 100 comprises at least a front axle 103*a*, a rear axle 103*b*, and a central axle 103*c*. Each void 129 formed by the elongated body 102 can further be threaded and configured to receive to receive an axle 103*a*, 103*b*, 103*c* that is partially threaded. The void 129 and the axle 103*a*, 103*b*, 103*c* are arranged together to form a threadable engagement. In this illustrative embodiment, the axle 103*a*, 103*b*, 103*c* is comprised of a metal material, and more particularly comprised of a steel or steel alloy. The length of the axle 103*a*, 103*b*, 103*c* will vary based upon the characteristics (i.e. dimensions, etc.) of the void 129. This specific embodiment illustrates the truck comprising at least four axles. As will be further discussed below, each axle is configured to receive at least one wheel 104.

FIGS. 1-7 further illustrates that each axle 103*a*, 103*b*, 103*c* connected to the elongated body 102 of the hanger 101 is configured to retain at least one wheel 104. In this arrangement, a wheel is positioned proximal to the first end 130 and the second end 131 of the elongated body 102. Therefore, terminology throughout the specification may consider that the wheel 104 proximal to the first end 130 of the elongated body 102 is a leftward wheel. Similarly, terminology throughout the specification may consider that the wheel 104 proximal to the second end 131 of the elongated body 102 is a rightward wheel.

b. Pivot Saddle

The elongated body 102 of the hanger 101 is integrally connected to the pivot saddle 105 (see FIG. 5). The pivot saddle 105 enables the wheels 104 to turn or alter the direction of the skateboard deck 111. In this particular embodiment, the pivot saddle 105 is symmetrically positioned relative to the width of the elongated body 102. As described above, the pivot saddle 105 comprises a pivot body 106 (which forms an aperture 132) and a pivot tip 107. The aperture 132 of the pivot body 106 comprises a diameter of approximately 0.5 inch. In alternative embodiments, the diameter of the pivot body aperture 132 can range between approximately 0.2 inches and approximately 3 inches.

The pivot body and pivot tip combine to form a pivot body length 133. The pivot body length 133 can range between 1 inch and 5 inches. In particular, the pivot body length 133 can be 1 inch, 1.5 inches, 2 inches, 2.5 inches, 3 inches, 3.5 inches, 4 inches, 4.5 inches, or 5 inches. In the illustrative embodiment, the pivot body length 133 can be approximately 2.5 inches. The pivot body length 133 can vary based upon the intended use of the rider. For example, a shorter pivot body length 133 (i.e. less than 2.5 inches) may be desirable if the user wants a more responsive truck with respect to movement in the left and/or right direction, or vice versa a longer pivot body length 133 for a less responsive truck (i.e. greater than 2.5 inches). A shorter pivot body length, however, can introduce wheel bite (wheels contacting the bottom surface of the skateboard), which creates the need for rotation inhibiting structures 127.

c. Rotation Inhibiting Structure

The pivot saddle 105 of the hanger 101 further comprises an integrally connected rotation inhibiting structure 127. The rotation-inhibiting structure prevents one or more arms 117 from over rotating to the point where the wheels 104 engage the bottom surface 112 of the skateboard deck 111. As illustrated by FIGS. 1-7, the rotation-inhibiting structure(s) 127 are adjacent, coplanar, and on opposing sides of the pivot saddle 105 and spaced from the elongated body 102. In alternative embodiments, only one rotation-inhibiting structure 127 is needed to prevent the arms 117 from over rotating, as the arms 117 are coupled to one another by axles. Therefore, the arms 117 move, rotate, and stop in unison.

The rotation-inhibiting structure spacing distance can be defined as being measured perpendicularly from the elongated body 102 to the rotation inhibiting structure 127. The rotation inhibiting structure spacing distance can range between 0.125 inch and 3 inches. In particular, the rotation inhibiting structure spacing distance can be between 0.125 inch-0.225 inch, 0.225 inch-0.325 inch, 0.325 inch-0.425 inch, 0.425 inch-0.525 inch, 0.525 inch-0.625 inch, 0.625 inch-0.725 inch, 0.725 inch-0.825 inch, 0.825 inch-0.925 inch, 0.925 inch-1.025 inch, 1.025 inch-1.125 inch, 1.125 inch-1.225 inch, 1.225 inch-1.325 inch, 1.325 inch-1.425 inch, 1.425 inch-1.525 inch, 1.525 inch-1.625 inch, 1.625 inch-1.725 inch, 1.725 inch-1.825 inch, 1.825 inch-1.925 inch, 1.925 inch-2.025 inch, 2.025 inch-2.125 inch, 2.125 inch-2.225 inch, 2.225 inch-2.325 inch, 2.325 inch-2.425 inch, 2.425 inch-2.525 inch, 2.525 inch-2.625 inch, 2.625 inch-2.725 inch, 2.725 inch-2.825 inch, 2.825 inch-2.925 inch, or 2.925 inch-3.025 inch.

The geometry of the rotation inhibiting structure 127 of this exemplary embodiment includes a center portion 134 comprising a semi-circular profile and elongated end protrusions 135 connected to both sides of the semi-circular profile.

As previously mentioned, the center portion 134 of the rotation-inhibiting structure 127 comprises a semi-circular profile. The semi-circular profile of the center portion 134 can have a diameter that ranges between 0.1 inch to approximately 1 inch. For example, in some embodiments, the diameter of the semi-circular profile can be 0.1-inch, 0.2-inch, 0.3-inch, 0.4-inch, 0.5-inch, 0.6-inch, 0.7-inch, 0.8-inch, 0.9-inch, or 1-inch. In other embodiments, the diameter of the semi-circular profile can be between 0.1 inch-0.3-inch, 0.3 inch-0.5-inch, 0.5 inch-0.8-inch, or 0.8 inch-1.1 inch.

As described above, the semi-circular profile of the center portion 134 is connected to elongated end protrusions 135 that protrudes from the semi-circular profile. The elongated end protrusions 135 can generally take any shape, length, or geometry, as long as, the elongated end protrusions are configured to limit rotation of the one or more arm(s) 117 to a predetermined angle. In many embodiments, the elongated end protrusions 135 can be non-circular or non-elliptical. In the illustrative embodiment, the length of rotation inhibiting structure is approximately 2.5 inches (measured along the longitudinal direction of the skateboard). Rotation of the one or more arm(s) 117 is limited when a portion of the arm contacts a portion of the rotation inhibiting structure 127, thereby forming a mechanical stop (see FIG. 7).

As previously mentioned, the length of the rotation-inhibiting structure is measured in a direction extending along the longitudinal axis of the skateboard deck 111. In many embodiments, the length of the rotation-inhibiting structure can range between approximately 0.5 inch and approximately 4 inches. For example, the length of the rotation-inhibiting structure can be between 0.5 inch-0.75 inch, 0.75 inch-1.00 inch, 1.0 inch-1.25 inch, 1.25 inch-1.50 inch, 1.50 inch-1.75 inch, 1.75 inch-2.00 inch, 2.00 inch-2.25 inch, 2.25 inch-2.50 inch, 2.50 inch-2.75 inch, 2.75 inch-3.00 inch, 3.00 inch-3.25 inch, 3.25 inch-3.50 inch, 3.50 inch-3.75 inch, or 3.75 inch-4.00 inch.

The width of the rotation inhibiting structure 127 can vary based upon the width of the one or more arms. In general, the width of the rotation inhibiting structure 127 may be approximately the same width of the one or more arms 117 or less than the widths of the one or more arms 117. Constraining the width to be approximately the same or less than the width of the one or more arms 117 ensures that enough surface area of the rotation inhibiting structure 127 contacts the one or more arms 117 to prevent over rotation.

In this embodiment, the width of the rotation inhibiting structure 127 is approximately 0.375 inch. However, in other embodiments, the width of the rotation inhibiting structure can vary between 0.125 inch to approximately 0.6 inch. For example, the width of the rotation inhibiting structure can be between 0.125 inch-0.145 inch, 0.145 inch-0.165 inch, 0.165 inch-0.185 inch, 0.185 inch-0.205 inch, 0.205 inch-0.225 inch, 0.225 inch-0.245 inch, 0.245 inch-0.265 inch, 0.265 inch-0.285 inch, 0.285 inch-0.305 inch, 0.305 inch-0.325 inch, 0.325 inch-0.345 inch, 0.345 inch-0.365 inch, 0.365 inch-0.385 inch, 0.385 inch-0.405 inch, 0.405 inch-0.425 inch, 0.425 inch-0.445 inch, 0.445 inch-0.465 inch, 0.465 inch-0.485 inch, 0.485 inch-0.505 inch, 0.505 inch-0.525 inch, 0.525 inch-0.555 inch, 0.555 inch-0.575 inch, 0.575 inch-0.595 inch, or 0.595 inch-0.615.

d. Arm(s)

As illustrated by FIG. 6, the middle region 121 of the arm(s) 117 are positioned in the space (or gap) between the rotation inhibiting structure 127 and the elongated body 102. As mentioned above, the one or more arms can further comprise a front region, which can be similar to the first segment, a rear region, which can be similar to the second segment, and a middle region, which is in between the first segment and the second segment. In some embodiments, the first segment 118 and the second segment 119 of the arms 117 are equivalent lengths and coplanar to one another. In other embodiments, the length of the arms 117 can range between approximately 4 inches and approximately 9 inches. The length of the arms 117 can be between approximately 4 inches-approximately 5 inches, approximately 5 inches-approximately 6 inches, approximately 6 inches-approximately 7 inches, approximately 7 inches—approximately 8 inches, or approximately 8 inches—approximately 9 inches. In further embodiments, the length of the arms 117 can be approximately 4 inches, approximately 5 inches, approximately 6 inches, approximately 7 inches, approximately 8 inches, or approximately 9 inches.

FIG. 3 illustrates a close-up view of FIG. 1. FIG. 3 illustrates that the one or more arms 117 can be divided into a front region 120, a middle region 121, and a rear region 122. As previously described, the front region 120 is similar to the first segment 118, the rear region 122 is similar to the second segment 119, and the middle region 121 is between the front region 120 and the rear region 122.

FIG. 3 further illustrates the front region 120 forming a front aperture 123, the middle region 121 forming a middle aperture 124, and the rear region 122 forming a rear aperture 125. In the illustrative embodiment, the front aperture 123 and the rear aperture 125 comprise a smaller diameter relative to the diameter of the middle aperture 124. Specifically, the diameter of the front aperture 123 and the rear aperture 125 are approximately 0.3 inch and the diameter of the middle aperture 124 is approximately 0.8 inch.

FIGS. 1-4 further illustrate that the front aperture 123 and the rear aperture 125 of each arm 117 can be configured to receive an axle 103*a*, 103*b*. Each axle 103*a*, 103*b* is configured to retain a wheel 104. In this arrangement, at least two wheels 104 are positioned in between (or enclosed by) the arms 117 (or a first arm and a second arm). In other words, at least two wheels are pinned between two arms 117. Therefore, terminology throughout the specification may consider that the wheel 104 proximal to the front aperture 123 of the arm 117 is a leading and/or forward wheel. Similarly, terminology throughout the specification may consider that the wheel 104 proximal to the rear aperture 125 of the arm 117 is a trailing wheel and/or rear wheel.

e. Friction Reducing Element

Referring back to FIGS. 1-4, the embodiment of the truck 100, 200 further includes a friction reducing element 126 configured to be received within the middle aperture 124 of the arms 117 (i.e. first arm and second arm). In the case of this embodiment, the friction reducing element is comprised of a nylon material and approximately the same width of the arms 117 and the diameter of the middle aperture 124.

f. Base Plate

As previously described, the base plate 108 is the component of the truck that couples the elongated body 102, the wheels 104, and the pivot saddle 105 to the skateboard deck 111 (see FIG. 1). The base plate forms a plurality of bolt receiving ports 109, at least one king pin receiving aperture 116, and at least one pivot cup receiving port 115. These receiving ports provide receiving geometries for a plurality of bolts, a king pin, and the pivot tip of the pivot saddle, respectively. Thereby, securing the moving wheel platform or the truck to a given apparatus.

The arrangement of the aforementioned truck components described herein enables individuals riding skateboards or longboards to more efficiently maneuver over cracks in sidewalks as the configuration of the truck components enables the wheels coupled to the elongated body of the hanger to be suspended over a contraction joint (i.e. prevents the wheels from descending into the crack when the user is moving over a contraction joint). Further, the rotation-inhibiting structures prevents the wheels coupled to the rotatable arms 117 from contacting a bottom portion of the skateboard (i.e. preventing wheel bite).

Skateboard Truck II

FIGS. 8-11 illustrates another embodiment of a moving wheel platform (or truck). The truck described herein comprises an elongated body 302 having a pivot saddle 305 protruding (or extending) therefrom. The elongated body 302 and the pivot saddle 305 cooperate to form one or more rotation inhibiting structure(s) 327 in the form of a void. In many embodiments, one or more arms 317 can be positioned in the space formed by the void defined by the rotation inhibiting structure 327.

The one or more arm(s) 317 further comprises a first rotation inhibiting protrusion 341 and a second rotation inhibiting protrusion 342 that extends outwardly away from the arms 317. When the arms 317 are assembled to the hanger, the first rotation inhibiting protrusion 341 and the second rotation inhibiting protrusion 342 forms an overlapping structure that surrounds (or encompasses) a portion of the pivot body 306. As the arms 317 begin to rotate/pivot away from the ground surface, the first rotation inhibiting protrusion 341 and the second rotation inhibiting protrusion 342 can contact the pivot body 306 providing a mechanical stop to prevent over rotation of the arms 317.

Figure 9:
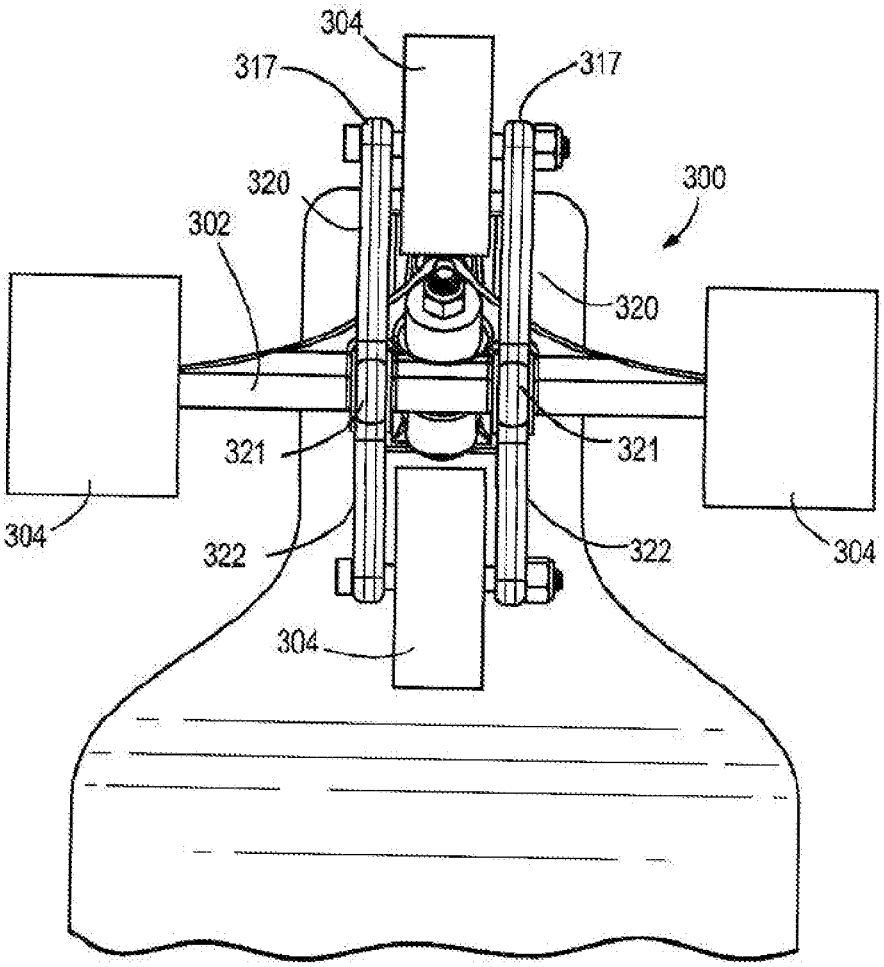
FIG. 9 shows the assembled moving wheel platform of FIG. 8 coupled to a skateboard.
Figure 10:
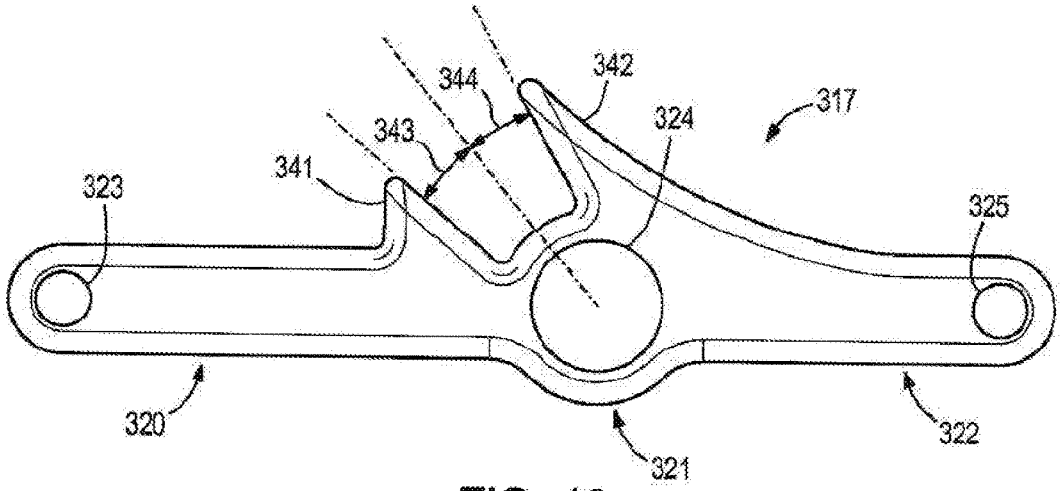
FIG. 10 shows a close-up view of the arm of FIG. 8.
Figure 11:
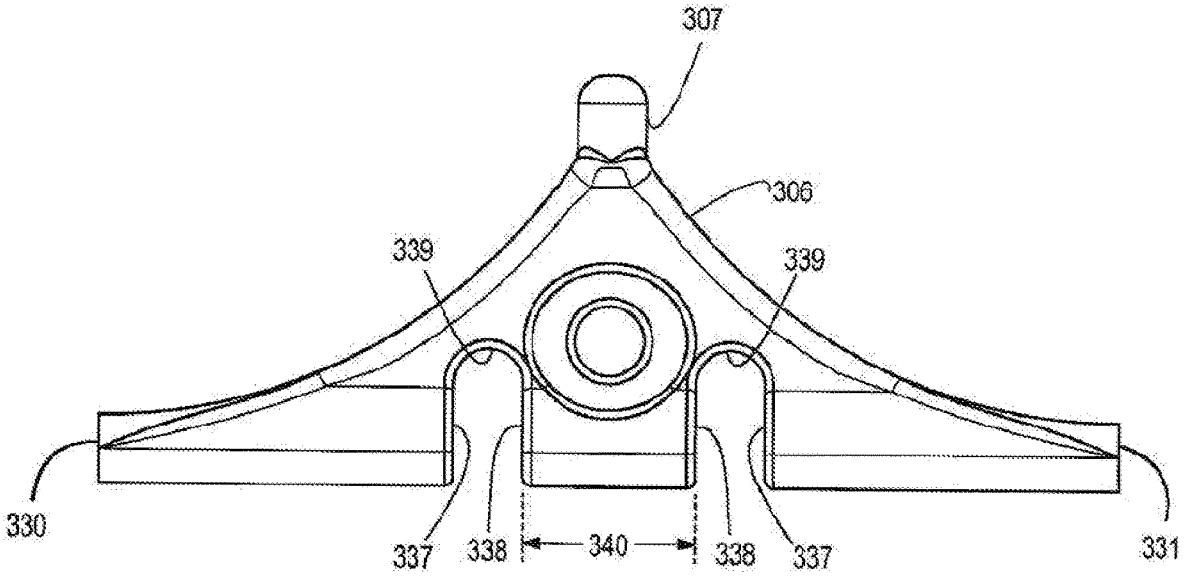
FIG. 11 shows a close-up view of the hanger of FIG. 8.

FIG. 8 illustrates an exploded view of a moving wheel platform according to some aspects of this invention. FIG. 9 further illustrates that the moving wheel platform (or truck) 300 can be mounted to a longboard or another apparatus, in accordance with some aspects of this invention. FIGS. 10 and 11 each individually illustrate a hanger and an arm, respectively.

In the embodiments of FIGS. 8-11, the truck 300 comprises a plurality of components including a hanger 301 having an elongated body 302, one axle 303, a pivot saddle 305 having a pivot body 306 and a pivot tip 307, a base plate 308, at least two arms 317, at least two rotation inhibiting structures 327, and at least two friction reducing elements 326.

I. Elongated Body

The elongated body 302 of this embodiment is configured to be approximately the width of a skateboard deck 311 (of FIG. 9). As previously described, the width of the elongated body 302 can range between approximately 4 inches to approximately 10 inches. In particular, the width of the elongated body 302 can be 4 inches, 5 inches, 6 inches, 7 inches, 8 inches, 9 inches, or 10 inches. In this exemplary embodiment, the width of the elongated body 302 is approximately 7 inches.

The elongated body 302 forms a bore 329 that extends entirely through both the first end 330 and the second end 331 of the elongated body 302. In other words, the bore 329 extends entirely (100%) through the width of the elongated body 302. In this embodiment, the elongated body is formed from Aluminum 6061 or the cast equivalent Aluminum A356.

II. Axle

The bore 329 defined by the elongated body 302 is configured to rigidly receive one axle 303. Specifically, when compared to the previous embodiment (FIGS. 1-7), this embodiment requires only one axle. This not only requires less components compared to the previous embodiment, but further enables the elongated body to better support the axle, as more surface area of the elongated body is engaged with the axle. In this embodiment, the axle 303 is comprised of a metal material, and more particularly comprised of a steel or steel alloy. The length of the axle 303 will vary based on the width of the elongated body 302. As will be further discussed below, each axle is configured to receive one or more wheels 304.

The axle 303 comprises four segments. The first segment of the axle is proximal to the first end of the elongated body. The second segment of the axle is proximal to the second end of the elongated body. The third segment of the axle is in between the first segment and the second segment. The fourth segment of the axle is in between the first segment and the second segment and comprises a hanger stop 346 that abuts a portion of the elongated body, and particularly, the first end of the elongated body.

The hanger stop 346 wraps circumferentially around the axle 303 and is the thickest portion of the axle. The first segment of the axle extends from the first end of the elongated body to create a first overhang portion. Similarly, the second segment of the axle extends from the second end of the elongated body to create a second overhang portion. The first and second overhang portions accommodate, the first and second wheels for securing the first and second wheels to the axle 303, respectively.

III. Rotation Inhibiting Structures

The elongated body 302 further forms at least two rotation inhibiting structures 327 in the form of a gap, a notch, a slot, or a slit. The rotation inhibiting structures 327 are offset and/or spaced from the first end 330 and second end 331 of the elongated body 302. For example, in the illustrated embodiment of FIGS. 8-10, the rotation inhibiting structures 327 are symmetrically positioned along the width of the elongated body 302. Specifically, in the illustrated embodiment, the rotation inhibiting structures 327 are offset approximately 34% from the first end 330 and the second end 331 of the elongated body, respectively.

However, in alternative embodiments, the rotation inhibiting structures 327 can be offset from the first end 330 or the second end 331 of the elongated body between 5% and 50%. For example, in many embodiments, the offset distance between the first end and the rotation inhibiting structure 327 or the second end and the rotation inhibiting structure 327 can be 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, or 50%.

The rotation-inhibiting structure 327 comprises at least three internal sidewalls defined by the elongated body 302 (i.e. a first internal sidewall 337, a second internal sidewall 338, and a third internal sidewall 339). The first internal wall is defined as the sidewall closest to either one of the first end 330 or the second end 331 of the elongated body 302. The second internal wall 338 is defined as the sidewall proximal to a sidewall of the other rotation inhibiting structure 327. The third internal wall sidewall 339 shares a common edge with both the first internal wall 337 and the second internal wall 339. The first internal sidewall 337, the second internal sidewall 338, and the third internal sidewall 339 forms a void therebetween. In many embodiments, where the one or more sidewalls meet to form an edge, a radius can be present.

The distance between a pair of rotation-inhibiting structures 327 can be referred to as a rotation inhibiting structure spacing distance 340. The rotation inhibiting structure spacing distance 340 can be defined as the distance measured between the pair of rotation-inhibiting structures second internal sidewalls 338. In the illustrated embodiment, the rotation inhibiting structure spacing distance 340 is approximately 1.25 inches. However, in alternative embodiments, the rotation inhibiting structure spacing distance 340 may range between 0.25 inches and 2 inches.

In other embodiments, the rotation inhibiting structure spacing distance 340 can range between approximately 0.25 inch-0.50 inch, 0.50 inch-0.75 inch, approximately 0.75 inch-1.00 inch, approximately 1.00 inch-1.25 inch, approximately 1.25 inch-1.50 inch, approximately 1.50 inch-1.75 inch, or approximately 1.75 inch-2.00 inch. The rotation inhibiting structure can be approximately 0.25-inch, 0.50-inch, approximately 0.75 inch, approximately 1.00 inch, approximately 1.25 inch, approximately 1.50 inch, approximately 1.75 inch, or approximately 2.00 inch.

IV. Arm(s)

With continued reference to FIG. 10, the one or more arms 317 can be divided into a front region 320, a middle region 321, and a rear region 322. As previously described (and similar to the previously mentioned arms 117), the front region 320 is similar to the first segment 318, the rear region 322 is similar to the second segment 319, and the middle region 321 is between the front region 320 and the rear region 322. FIGS. 8 and 10 further illustrates the front region 320 forms a front aperture 323, the middle region 321 forms a middle aperture 324, and the rear region 322 forms a rear aperture 325. In the illustrative embodiment, the front aperture 323 and the rear aperture 325 comprises a smaller diameter than the diameter of the middle aperture 324.

The middle region of the one or more arms 317 comprises a first rotation inhibiting protrusion 341 protruding from the middle region and front region 320 of the arm 317, a second rotation inhibiting protrusion 342 protruding from the middle region and rear region 322 of the arm 317, and a middle aperture 324. The first rotation inhibiting protrusion 341 is closer to the front region 320 of the arm 317 than the rear region 322 of the arm 317. The second rotation inhibiting protrusion 342 is closer to the rear region 322 than the front region 320.

An imaginary centerline axis is symmetrically positioned between the first rotation inhibiting protrusion 341 and the second rotation inhibiting protrusion 342 and extends through a center point of the middle aperture 324. Thereby, forming a first rotation inhibiting protrusion angle between the centerline axis and the first rotation inhibiting protrusion and a second rotation inhibiting protrusion angle between the centerline axis and the second rotation inhibiting protrusion The first rotation inhibiting angle 343 can range between 2 degrees and 6 degrees. In some embodiments, the first rotation inhibiting angle 343 can range approximately between 2 degrees-2.5 degrees, 2.5 degrees-3 degrees, 3 degrees-3.5 degrees, 3.5 degrees-4 degrees, 4 degrees-4.5 degrees, 4.5 degrees-5 degrees, 5 degrees-5.5 degrees, or 5.5 degrees-6 degrees. In alternative embodiments, the first rotation inhibiting angle 343 can be approximately 2 degrees, approximately 2.5 degrees, approximately 3 degrees, approximately 3.5 degrees, approximately 4 degrees, approximately 4.5 degrees, approximately 5 degrees, approximately 5.5 degrees, or approximately 6 degrees. In the illustrated embodiment, the first rotation inhibiting angle is approximately 4 degrees.

The second rotation inhibiting angle 344 can range approximately between 12 degrees and 18 degrees. In some embodiments, the second rotation inhibiting angle 344 can range between 12 degrees-13 degrees, 13 degrees-14 degrees, 14 degrees-15 degrees, 16 degrees-17 degrees, or 17 degrees-18 degrees. In alternative embodiments, the first rotation inhibiting angle 344 can be 12 degrees, 12.5 degrees, 13 degrees, 13.5 degrees, 14 degrees, 14.5 degrees, 15 degrees, 15.5 degrees, 16 degrees, 16.5 degrees, 17 degrees, 17.5 degrees, or 18 degrees. In the illustrated embodiment, the second rotation inhibiting angle 344 is approximately 16 degrees.

The middle region of the arms 317 can be sized, arranged, and/or configured to be received within the void 345 of the rotation inhibiting structures 327. The axle 302 not only extends entirely through elongated body, but also extends through the void 345 and middle aperture 324, thereby rigidly supporting both the elongated body of the hanger and the arm(s) while providing an axis of rotation for the arms 317 to rotate about. The combination of the rotation inhibiting structure 327 and the first and second rotation inhibiting protrusion 341, 342 of the arms 117 forms an overlapping structure that surrounds (or encompasses) a portion of the pivot body.

When the truck 300 is in a zero-degree reference angle configuration, the overlapping structure will not be felt or apparent to the rider, however, as the arms 317 begin to rotate/pivot away from the ground surface, the first rotation inhibiting protrusion and the second rotation inhibiting protrusion can contact the pivot body 306 providing a mechanical stop. This mechanical stop prevents over rotation of the one or more arms to the point where the wheels 304 contact the bottom surface of the skateboard deck.

FIG. 8 further illustrate that the front aperture 323 and the rear aperture 325 of each of the arms 317 is configured to an axle. Each axle 303 is configured to retain at least one wheel 304. In this arrangement, two or more wheels can be positioned in between arms 317. Therefore, terminology throughout the specification may consider that the wheel 304 (pinned) proximal to the front aperture 323 of the arms 317 is a leading and/or forward wheel. Similarly, terminology throughout the specification may consider that the wheels 304 (pinned) proximal to the rear aperture 325 of the arm 317 is a trailing wheel and/or rear wheel.

With continued reference to FIGS. 8 and 10, the embodiment of the truck 300 further includes a friction reducing element 326 configured to be received within the middle aperture 324 of the arms 317. In the case of this embodiment, the friction reducing element is composed of a nylon material and approximately the same width of the arms 317 and the diameter of the middle aperture 324. In many embodiments, the friction reducing element 326 can be press fit into the middle aperture 324.

V. Pivot Saddle

Still Referencing FIGS. 8-10, the pivot body 306 and the pivot tip 307 forms a pivot saddle 305 that is substantially triangular. This type of triangular arrangement extends from the first end 330 of the elongated body 302 and the second end 331 of the elongated body 302. This type of arrangement acts as a structural support mechanism to the elongated body 302, as the pivot saddle 305 is substantially engaged to the entire width of the elongated body 302.

As previously mentioned, the base plate 308 is the component of the truck that couples the elongated body 302, the wheels 304, and the pivot saddle 305 to the skateboard deck 111. The base plate 308 forms a plurality of bolt receiving ports 309, at least one king pin receiving aperture 316, and at least one pivot cup receiving port 315. These receiving ports provide receiving geometries for a plurality of bolts, a king pin, and the pivot tip of the pivot saddle, respectively. Thereby, securing the moving wheel platform or the truck to a given apparatus.

The arrangement of the aforementioned truck components enables individuals riding skateboards or longboards to more efficiently maneuver over cracks in sidewalks, as the configuration of the truck components enables the wheels coupled to the elongated body of the hanger to be suspended over a contraction joint (i.e. prevents the wheels from descending into the crack when the user is moving over a contraction joint). Further, the rotation-inhibiting structures and rotation inhibiting protrusions of the arms cooperate to prevents one or more wheels from contacting a bottom portion of the skateboard (i.e. preventing wheel bite).

Skateboard Truck III

Figure 12:
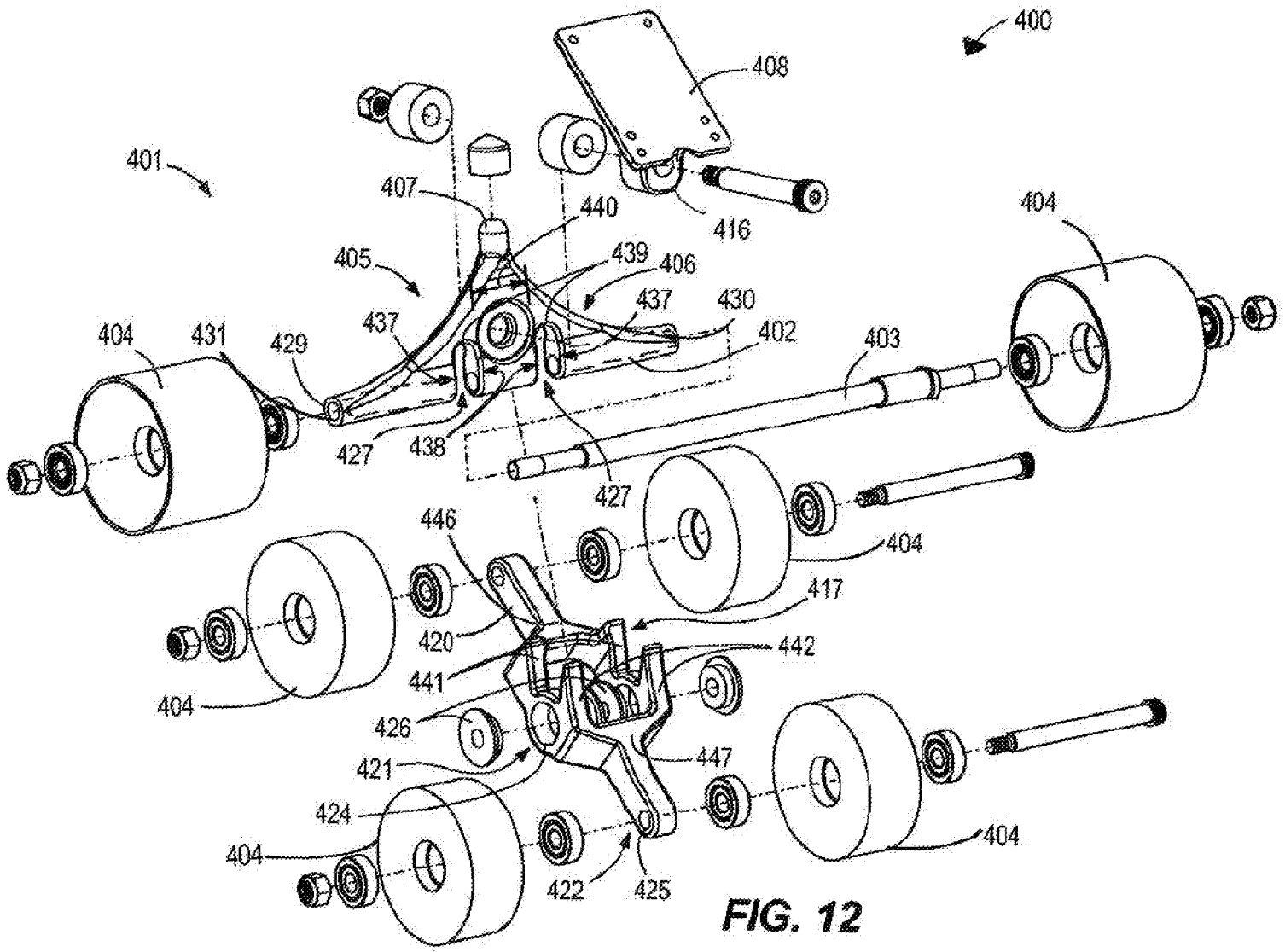
FIG. 12 shows an exploded view of a moving wheel platform according to another embodiment.
Figure 13:
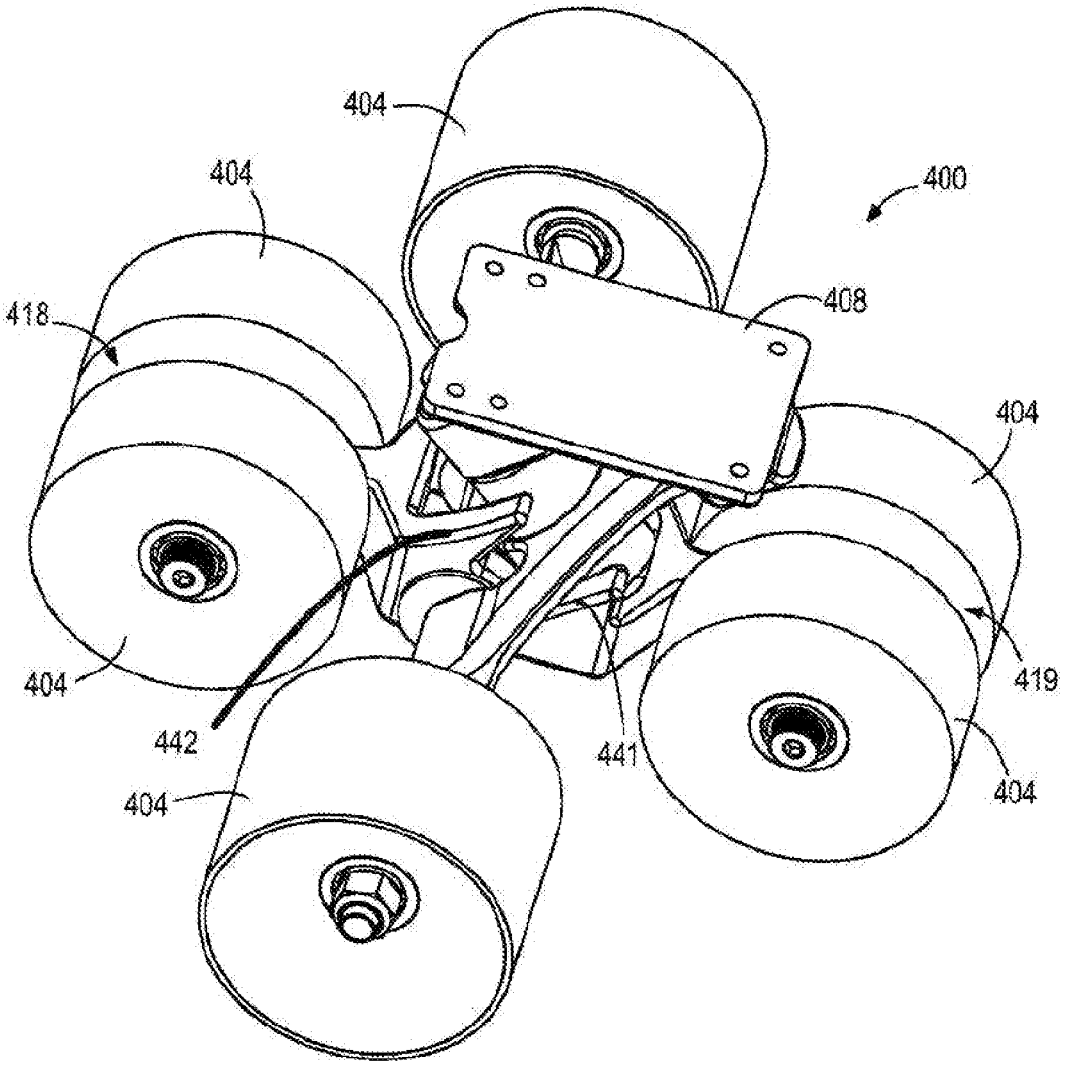
FIG. 13 shows the assembled moving wheel platform of FIG. 12.
Figure 14:
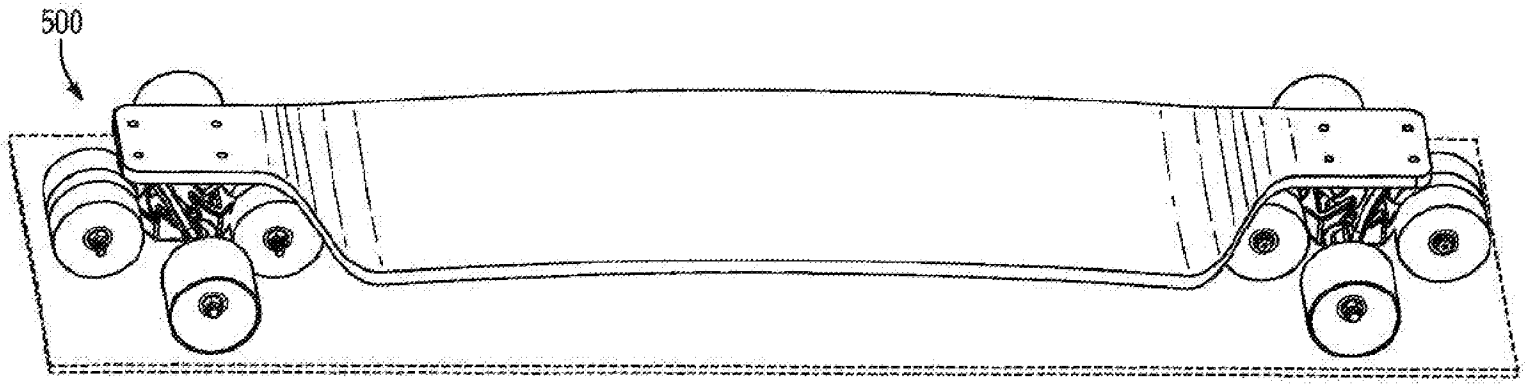
FIG. 14 shows the moving wheel platform of FIG. 12 coupled to a skateboard deck.
Figure 15:
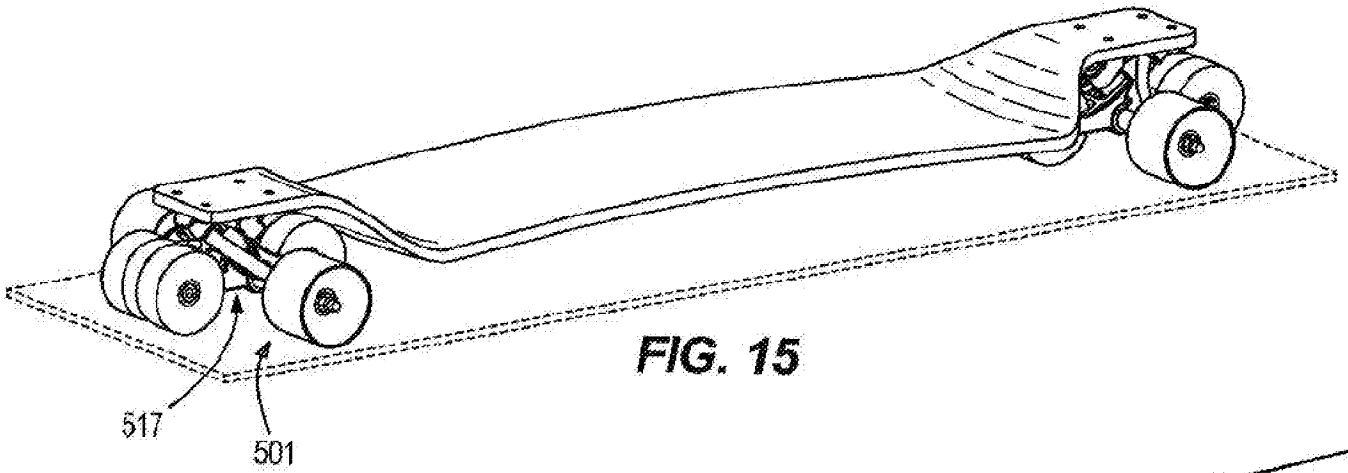
FIG. 15 shows a moving wheel platform coupled to a skateboard deck according to another embodiment.
Figure 16:
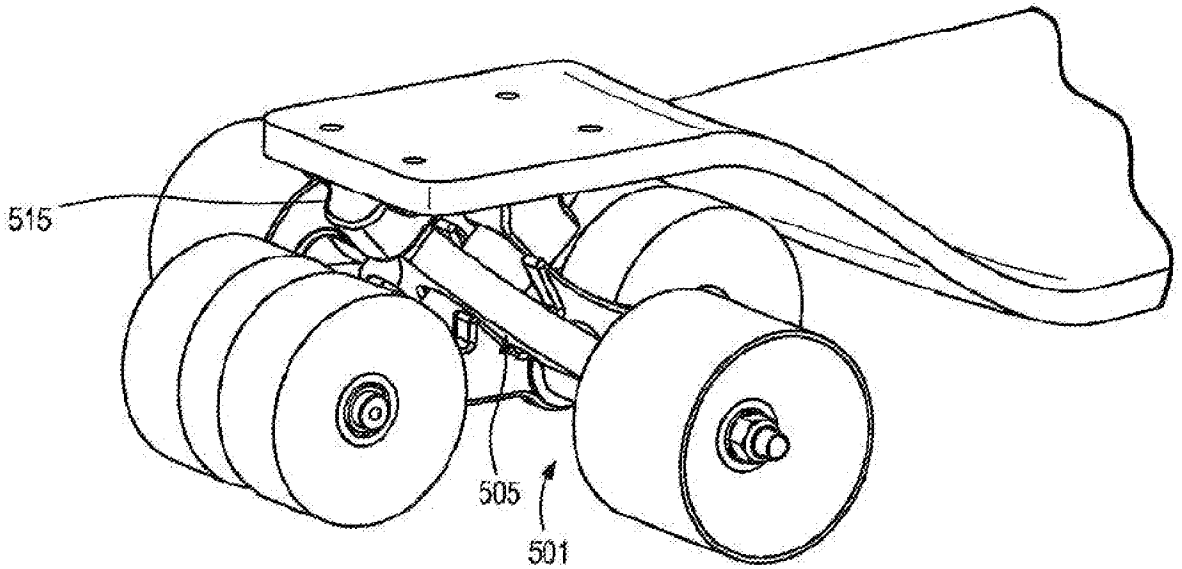
FIG. 16 shows a close-up view of FIG. 15.

FIGS. 12 and 13 illustrates another embodiment of a moving wheel platform according to this invention. The truck described herein comprises an elongated body 402 having a pivot saddle 405 protruding (or extending) therefrom. The elongated body 402 and the pivot saddle 405 cooperate to form one or more rotation inhibiting structure(s) 427 in the form of a void. In many embodiments, only one arm 417 is needed to occupy the space formed by the void defined by one or more rotation inhibiting structure(s) 427. More particularly, FIG. 12 illustrates an exploded view of a truck 400 according to another embodiment. FIG. 13 illustrates an assembled view of the truck 400 of FIG. 12.

Similarly, to the above truck embodiments, FIGS. 12 and 13 illustrates a preferred arrangement of the above described components to form the truck 400. In this embodiment, the components of the truck 400 includes a hanger 401 including an elongated body 402, at least one axle 403, a pivot saddle 405 having a pivot body 406 and a pivot tip 407, a base plate 408, only one arm 417, at least two rotation inhibiting structures 427, and at least two sets of friction reducing elements 426.

The elongated body 402 of this embodiment is similar to the elongated body 302 of the previous embodiments and configured to be approximately the width of a skateboard deck 411 (not shown). As previously described above, the width of the elongated body 402 can range between 4 inches and 10 inches. In particular, the width of the elongated body 402 can be 4 inches, 5 inches, 6 inches, 7 inches, 8 inches, 9 inches, or 10 inches. In this example, the width of the elongated body 402 is approximately 7 inches.

The elongated body 402 forms a bore 429 that extends entirely through both the first end 430 and the second end 431 of the elongated body 402. The bore 429 extends entirely (100%) through the width of the elongated body 402. In this embodiment, the elongated body can be formed from Aluminum 6061 or the cast equivalent Aluminum A356.

The bore 429 is configured to rigidly receive one axle 403. Specifically, when compared to the previous embodiment (FIGS. 1-7) this embodiment requires only one axle. This not only requires less components compared to the previous embodiment but enables the axle 403 to better support the elongated body 402, as more surface area of the axle 403 is engaged with the elongated body 402.

The axle 403 can be comprised of a metal material, and more particularly comprised of a steel or steel alloy. The axle 403 further adds structural support to the elongated body 403, as the young's modulus is greater than the young's modulus of the elongated body 403 of the hanger. The length of the axle 403 will vary based upon the width of the elongated body 402. As will be further discussed below, each axle is configured to receive at least one wheel 404.

The elongated body 402 and pivot body 406 further defines and/or comprises at least two rotation inhibiting structures 427 in the form of a gap, a notch, a slot, or a slit. The rotation inhibiting structures 427 are offset and/or spaced away from the first end 430 and second end 431 of the elongated body 402. For example, in the embodiment of FIG. 12, the rotation inhibiting structures 427 are symmetrically positioned along the width of the elongated body 402. Specifically, in this embodiment, the rotation inhibiting structures 427 are offset approximately 34% from the first end 430 and the second end 431 of the elongated body, respectively. However, in other embodiments, the rotation inhibiting structures 427 may be offset from the first end 430 or the second end 431 of the elongated body 402 between 25% and 50%. For example, in many embodiments, the offset distance between the first end and the rotation inhibiting structure 427 or the second end and the rotation inhibiting structure 427 may be 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, or 50%.

The rotation-inhibiting structure 427 comprises at least three internal sidewalls (i.e. a first internal sidewall 437, a second internal sidewall 438, and a third internal sidewall 439). The first internal wall is defined as the sidewall closest to the either one of the first end 430 or the second end 431 of the elongated body 302. The second internal wall 438 is defined as the sidewall proximal to a sidewall of another rotation inhibiting structure 427. The third internal wall sidewall 439 shares a common edge with both the first internal wall 437 and the second internal wall 439. The first internal sidewall 437, the second internal sidewall 438, and the third internal sidewall 439 forms a void therebetween.

The distance between a pair of rotation-inhibiting structures 427 can be referred to as a rotation inhibiting structure spacing distance 440. The rotation inhibiting structure spacing distance 440 can be defined as the distance measured between the pair of rotation-inhibiting structures second internal sidewalls 438. In this particular embodiment, the rotation inhibiting structure spacing distance 440 can be approximately 1.25 inches.

However, in alternative embodiments, the rotation inhibiting structure spacing distance 440 may range between 0.50 inches and 2 inches. In other embodiments, the rotation inhibiting structure spacing distance 440 may range between 0.50 inch-0.75-inch, 0.75 inch-1.00 inch, 1.00 inch-1.25 inch, 1.25 inch-1.50 inch, 1.50 inch-1.75 inch, or 1.75 inch-2.00 inch. The rotation inhibiting structure may be 0.50-inch, 0.75 inch, 1.00 inch, 1.25 inch, 1.50 inch, 1.75 inch, or 2.00 inch.

FIG. 12 illustrates that the arm 417 can be divided into a front region 420, a middle region 421, and a rear region 422. As previously described above, the front region 420 is similar to the first segment 418, the rear region 422 is similar to the second segment 419, and the middle region 421 is between the front region 420 and the rear region 422. FIG. 11 further illustrates the front region 420 forming a front aperture 423, the middle region 421 forming a middle aperture 424, and the rear region 422 forming a rear aperture 425. In many embodiments, the front aperture 423 and the rear aperture 425 can form a smaller diameter than the diameter of the middle aperture 424.

The front region 420 further comprises a first region transition area 446. The rear region 422 comprises a second region transition area 447. The first region transition area 446 is defined as the area or portion where the front region 420 transitions to the middle region 421. The second region transition area 447 is defined as the area or portion where the rear region 422 transitions to the middle region 421. At the first region transition area 446, the arm 417 splits from one segment into two segments. At the second transition area 447, the arm 417 splits from one segment into two segments.

In this embodiment, the front region 420 can be a one segment region, the rear region 422 is also a one segment region, however, the middle region, which is in between the front region 420 and the rear region 422 is a two-segment region, which arranges to outline a substantially rectangular shape. Thereby, permitting only one arm 417 to occupy at least two rotation inhibiting structures 427 as the first and second rotation inhibiting protrusions are positioned on both sides of the middle region 421 two segment region.

In other embodiments, at the first region transition area 446, the arm 417 may split from one segment into two segments, three segments, or four segments. At the second transition area 447, the arm 417 may split from one segment into two segments, three segments, or four segments.

The middle region of the one or more arms 417 comprises a first rotation inhibiting protrusion 441, a second rotation inhibiting protrusion 442, and a middle aperture 424. The first rotation inhibiting protrusion 441 protrudes (or extends) from the middle region and is closer to the front region 420 than the rear region 322. The second rotation inhibiting protrusion 442 protrudes from the middle region and is closer to the rear region 422 than the front region 420. Further, the first and second rotation inhibiting protrusions 341, 342 are positioned on both sides of the middle region 421 two segment region.

Similarly, to the above described embodiment, a centerline axis exists between the first rotation inhibiting protrusion 441 and the second rotation inhibiting protrusion 442 and extends through a center point of the middle aperture 424. A first rotation inhibiting protrusion angle is formed between the centerline and the first rotation inhibiting protrusion. A second rotation inhibiting protrusion angle is formed between the centerline and the second rotation inhibiting protrusion.

Similarly, to the above described embodiment, the first rotation inhibiting angle 443 can range between 2 degrees and 6 degrees. In some embodiments, the first rotation inhibiting angle 443 can range between 2 degrees-2.5 degrees, 2.5 degrees and 3 degrees, 3 degrees-3.5 degrees, 3.5 degrees-4 degrees, 4 degrees-4.5 degrees, 4.5 degrees-5 degrees, 5 degrees-5.5 degrees, or 5.5 degrees-6 degrees. In alternative embodiments, the first rotation inhibiting angle 443 can be 2 degrees, 2.5 degrees, 3 degrees, 3.5 degrees, 4 degrees, 4.5 degrees, 5 degrees, 5.5 degrees, or 6 degrees. In the illustrated embodiment, the first rotation inhibiting angle is 4 degrees.

Similarly, to the above described embodiment, the second rotation inhibiting angle 444 can range between 12 degrees and 18 degrees. In some embodiments, the second rotation inhibiting angle 444 can range between 12 degrees and 13 degrees, 13 degrees-14 degrees, 14 degrees-15 degrees, 16 degrees-17 degrees, or 17 degrees-18 degrees. In alternative embodiments, the first rotation inhibiting angle 444 can be 12 degrees, 12.5 degrees, 13 degrees, 13.5 degrees, 14 degrees, 14.5 degrees, 15 degrees, 15.5 degrees, 16 degrees, 16.5 degrees, 17 degrees, 17.5 degrees, or 18 degrees. In the illustrated embodiment, the second rotation inhibiting angle 444 is 16 degrees.

The middle region of the arms 417 are configured to be received within the void 445 of the rotation inhibiting structures 427. The axle 402 not only extends entirely through elongated body, but also extends through the void 445 and middle aperture 424 of the arm 417, thereby rigidly supporting both the elongated body of the hanger but also provides an axis of rotation for the arm 417 to rotate about. The combination of the rotation inhibiting structure 427 and the first rotation inhibiting protrusion 441 of the arm 417 forms an overlapping structure that surrounds or encompasses a portion of the pivot body.

When the truck 400 is in a zero-degree reference angle configuration, the overlapping structure will not be felt or apparent to the rider, however, as the arms 417 begin to rotate/pivot away from the ground surface, the first rotation inhibiting protrusion and the second rotation inhibiting protrusion can contact the pivot body 406 providing a physical barrier. This physical barrier prevents over rotation of the one or more arms to the point where the wheels 404 contact the bottom surface of the skateboard deck (not shown).

FIGS. 12 and 13 further illustrates that the front aperture 423 and the rear aperture 425 of each of the arm 417 is configured to receive an axle. Each axle 403 is configured to retain at least one wheel 404. In this illustrated embodiment, four wheels are coupled to the arm 417 and positioned on each side (or opposing sides) of the arm 417 at the front aperture 423 and the rear aperture 425. Therefore, terminology throughout the specification may consider that the two wheels 404 proximal to the front aperture 423 of the arm 417 are the leading and/or forward wheels. Similarly, terminology throughout the specification may consider that the two wheels 404 proximal to the rear aperture 425 of the arm 417 are the trailing wheels and/or rear wheels.

With continued reference to FIGS. 12 & 13, the truck 400 further includes a friction reducing element 426 configured to be received within each middle aperture 424 of the arm 417. In the case of this embodiment, the friction reducing element is composed of a nylon material and approximately the same width of the arms 417 and the diameter of the middle aperture 424.

The pivot body 406 and the pivot tip 407 forms a pivot saddle 405 that is substantially triangular. This type of substantially triangular arrangement extends from the first end 430 of the elongated body 402 and the second end 431 of the elongated body 402, therefore additionally acting as a structural support mechanism to the elongated body 402. The axle 403 further adds structural support to the elongated body 403, as the young's modulus is greater than the young's modulus of the elongated body 403 of the hanger.

As previously described, the base plate 408 is the component of the truck that couples the elongated body 402, the wheels 404, and the pivot saddle 405 to the skateboard deck 411. The base plate 408 forms a plurality of bolt receiving ports 409, at least one king pin receiving aperture 416, and at least one pivot cup receiving port (not shown). These receiving ports provides receiving geometries for a plurality of bolts, a king pin, and the pivot tip of the pivot saddle, respectively. Thereby, securing the moving wheel platform or the truck to a given apparatus.

The arrangement of the aforementioned truck components enables individuals riding skateboards or longboards to more efficiently maneuver over cracks in sidewalks as the configuration of the truck components enables the wheels coupled to the elongated body of the hanger to be suspended over a contraction joint (i.e. prevents the wheels from descending into the crack when the user is moving over a contraction joint). Further, this embodiment requires only one arm while still utilizing rotation-inhibiting structures and rotation inhibiting protrusions of the arms to prevents one or more wheels from contacting a bottom portion of the skateboard (i.e. preventing wheel bite).

Skateboard Truck IV

FIGS. 14-20 illustrates another embodiment of a moving wheel platform according to this invention. The truck described herein comprises an elongated body 502 having a pivot saddle 505 protruding (or extending) therefrom. The elongated body 502 and the pivot saddle 505 cooperate to form one or more rotation inhibiting structure(s) 527 in the form of a void. In many embodiments, only one arm 517 is needed to occupy the space formed by the void defined by one or more rotation inhibiting structure(s) 527. More particularly, FIGS. 14-20 illustrates a truck 500 that can be mounted to a longboard (or another apparatus). The illustrated truck embodiment of FIGS. 14-20 is similar to the previously mentioned trucks.

FIGS. 14-20 illustrates an embodiment of the above described components to form the truck 500. In this embodiment, the components of the truck 500 includes a hanger 501 including an elongated body 502, at least one axle 503, a pivot saddle 505 having a pivot body 506 and a pivot tip 507, a base plate 508, only one arm 517, at least two rotation inhibiting structures 527, and at least two sets of friction reducing elements 526.

The elongated body 502 of this illustrated embodiment is similar to the elongated body 102, 202, 302, and 402 of the previous embodiments and configured to be approximately the width of a skateboard deck 511. As previously described above, the width of the elongated body 502 can range between 4 inches and 10 inches. In particular, the width of the elongated body 502 can be 4 inches, 5 inches, 6 inches, 7 inches, 8 inches, 9 inches, or 10 inches. In this illustrative example, the width of the elongated body 502 is approximately 7 inches.

The elongated body 502 forms a bore 529 that extends entirely through both the first end 530 and the second end 531 of the elongated body 502. The bore 529 extends 100% entirely through the width of the elongated body 502. In this particular embodiment, the elongated body is composed of Aluminum 6061 or the cast equivalent Aluminum A356.

The bore 529 can be configured to rigidly receive one axle 503. Specifically, when compared to Embodiment I, this embodiment requires only one axle. This not only requires less components compared to the previous embodiment, but enables the axle 503 to provide more support to the elongated body 502, as more surface area of the axle 503 is engaged with the elongated body 502.

In this illustrative embodiment, the axle 503 is comprised of a metal material, and more particularly comprised of a steel or steel alloy. The axle 503 further adds structural support to the elongated body 503, as the young's modulus is greater than the young's modulus of the elongated body 503 of the hanger. The length of the axle 503 will vary based on the width of the elongated body 502. This specific embodiment illustrates an axle width of approximately 8 inches. As will be further discussed below, each axle is configured to receive at least one wheel 504.

The elongated body 502 further includes at least two rotation inhibiting structures 527 in the form of a gap, a notch, a slot, or a slit. The rotation inhibiting structures 527 are offset and/or spaced away from the first end 530 and second end 531 of the elongated body 502. For example, in the illustrated embodiment of FIGS. 14-20, the rotation inhibiting structures 527 are symmetrically positioned along the width of the elongated body 502. Specifically, in the illustrated embodiment the rotation inhibiting structures 527 are offset approximately 34% from the first end 530 and the second end 531 of the elongated body, respectively. However, in other embodiments, the rotation inhibiting structures 527 may be offset from the first end 530 or the second end 531 of the elongated body 502 between 25% and 50%. For example, in many embodiments, the offset distance between the first end and the rotation inhibiting structure 527 or the second end and the rotation inhibiting structure 527 can be 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, or 50%.

Similarly, to FIG. 11 the truck 500 shares a similar hanger design of the hanger 301 of skateboard embodiment III and denoted as such. The rotation-inhibiting structure (327, 427) 527 comprises at least three internal sidewalls (i.e. a first internal sidewall (337, 437) 537, a second internal sidewall (338, 438) 538, and a third internal sidewall (339, 439) 539. The first internal wall is defined as the sidewall closest to the either one of the first end (330, 430) 530 or the second end (331, 431) 531 of the elongated body (302, 402) 502. The second internal wall (338, 438) 538 is defined as the sidewall proximal to a sidewall of the other rotation inhibiting structure (327, 427) 527. The third internal wall sidewall (339, 439) 539 shares a common edge with both the first internal wall (337, 437) 537 and the second internal wall (339, 439) 539. The first internal sidewall (337, 437) 537, the second internal sidewall (338, 438) 538, and the third internal sidewall (339, 439) 539 forms a void therebetween.

The distance between a pair of rotation-inhibiting structures (327, 427) 527 can be referred to as a rotation inhibiting structure spacing distance (340, 440) 540. The rotation inhibiting structure spacing distance (340, 440) 540 is defined as the distance measured between the pair of rotation-inhibiting structures second internal sidewalls (338, 438) 538. In the illustrated embodiment, the rotation inhibiting structure spacing distance (340, 440) 540 is approximately 1.25 inches. However, in alternative embodiments, the rotation inhibiting structure spacing distance (340, 440) 540 may range between 0.50 inches and 2 inches. In other embodiments, the rotation inhibiting structure spacing distance (340, 440) 540 may range between 0.50 inch-0.75-inch, 0.75 inch-1.00-inch, 1.00 inch-1.25 inch, 1.25 inch-1.50 inch, 1.50 inch-1.75 inch, or 1.75 inch-2.00 inch. The rotation inhibiting structure may be 0.50-inch, 0.75-inch, 1.00 inch, 1.25 inch, 1.50 inch, 1.75 inch, or 2.00 inch.

Figure 17:
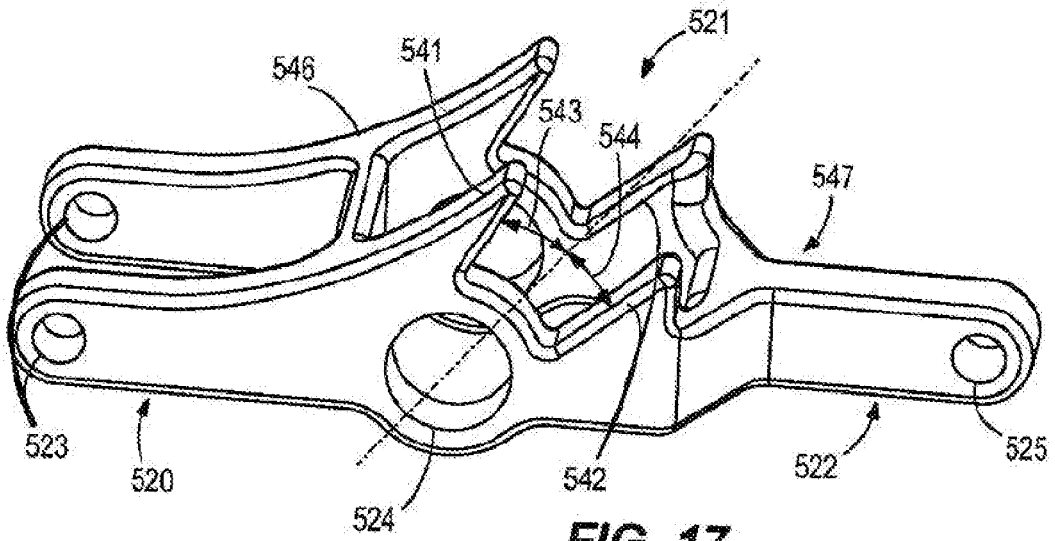
FIG. 17 shows an arm according to the embodiment of FIG. 15.
Figure 18:
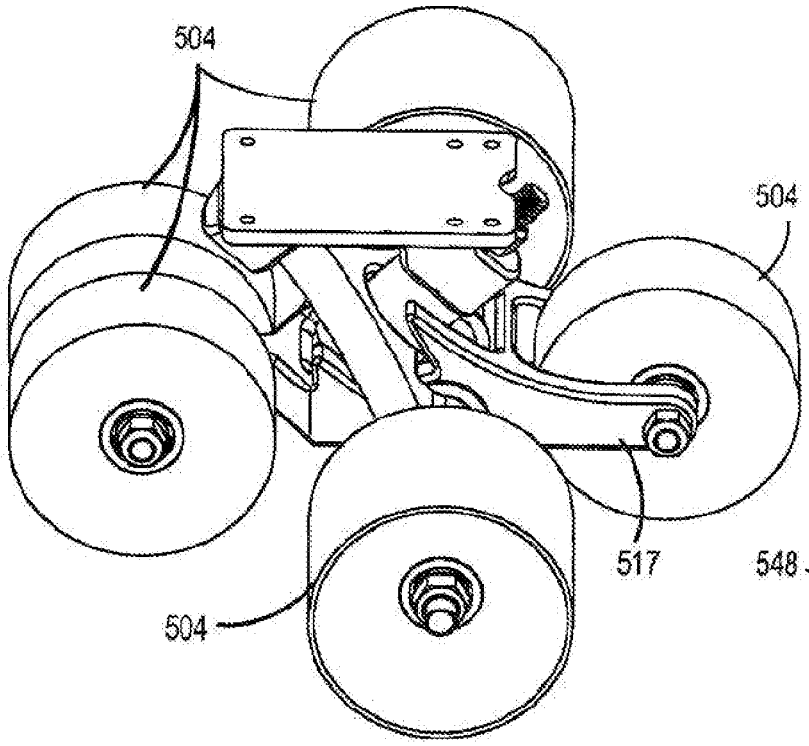
FIG. 18 shows the assembled view of the moving wheel platform of FIG. 15.
Figure 19:
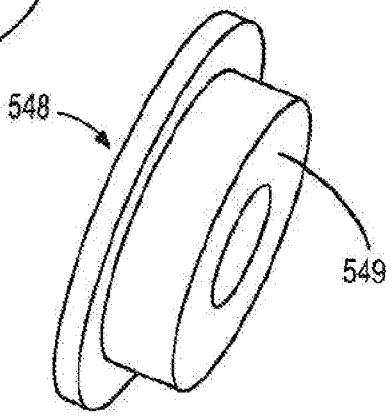
FIG. 19 shows a friction reducing element according to the embodiment of FIG. 15.

FIG. 17 illustrates that arm 517 can be defined by a front region 520, a middle region 521, and a rear region 522. As previously described above, the front region 520 is similar to the first segment 518, the rear region 522 is similar to the second segment 519, and the middle region 521 is between the front region 520 and the rear region 522. FIG. 12 further illustrates the front region 520 forming a front aperture 523, the middle region 521 forming a middle aperture 524, and the rear region 522 forming a rear aperture 525. In the illustrative embodiment, the front aperture 523 and the rear aperture 525 comprises a smaller diameter than the diameter of the middle aperture 524.

The front region 520 further comprises a first region transition area 546. The rear region 522 comprises a second region transition area 547. The first region transition area 546 is defined as the area or portion where the front region 520 transitions to the middle region 521. The second region transition area 547 is defined as the area or portion where the rear region 522 transitions to the middle region 521. At the first region transition area 546, the arm 517 maintains two segments (to house a wheel between the two segments). At the second transition area 547, the arm 517 transitions from one segment into two segments (see FIG. 17). As mentioned, the rear region of the arm is one segment and configured to have one or more wheels on opposing sides of the segment. In the illustrated embodiment, the front region 520 is a two-segment region, the rear region 522 is a one segment region, the middle region, which is in between the front region 520 and the rear region 522 is a two-segment region.

In other embodiments, at the first region transition area 546, the arm 517 may split into three segments, four segments, or five segments segments. At the section transition area 547, the arm 517 may split from one segment into two segments, three segments, or four segments.

Similarly to the above described arms (317, 417), the middle region of the one or more arms 517 comprises a first rotation inhibiting protrusion 541, a second rotation inhibiting protrusion 542, and a middle aperture 524. The first rotation inhibiting protrusion 541 is closer to the front region 520 than the rear region 522. The second rotation inhibiting protrusion 542 is closer to the rear region 522 than the front region 520. A centerline exists between the first rotation inhibiting protrusion 541 and the second rotation inhibiting protrusion 542 and extends through a center point of the middle aperture 524.

A centerline exists between the first rotation inhibiting protrusion 541 and the second rotation inhibiting protrusion 542 and extends through a center point of the middle aperture 524. A first rotation inhibiting protrusion angle is formed between the centerline and the first rotation inhibiting protrusion. A second rotation inhibiting protrusion angle is formed between the centerline and the second rotation inhibiting protrusion.

The first rotation inhibiting angle 543 can range between 2 degrees and 6 degrees. In some embodiments, the first rotation inhibiting angle 543 can range between 2 degrees-2.5 degrees, 2.5 degrees and 3 degrees, 3 degrees-3.5 degrees, 3.5 degrees-4 degrees, 4 degrees-4.5 degrees, 4.5 degrees-5 degrees, 5 degrees-5.5 degrees, or 5.5 degrees-6 degrees. In alternative embodiments, the first rotation inhibiting angle 543 can be 2 degrees, 2.5 degrees, 3 degrees, 3.5 degrees, 4 degrees, 4.5 degrees, 5 degrees, 5.5 degrees, or 6 degrees. In the illustrated embodiment, the first rotation inhibiting angle is 4 degrees.

The second rotation inhibiting angle 544 can range between 12 degrees and 18 degrees. In some embodiments, the second rotation inhibiting angle 544 can range between 12 degrees and 13 degrees, 13 degrees-14 degrees, 14 degrees-15 degrees, 16 degrees-17 degrees, or 17 degrees-18 degrees. In alternative embodiments, the first rotation inhibiting angle 544 can be 12 degrees, 12.5 degrees, 13 degrees, 13.5 degrees, 14 degrees, 14.5 degrees, 15 degrees, 15.5 degrees, 16 degrees, 16.5 degrees, 17 degrees, 17.5 degrees, or 18 degrees. In the illustrated embodiment, the second rotation inhibiting angle 544 is 16 degrees.

The middle region of the arms 517 can be configured to be received within the void 545 of the rotation inhibiting structures 527. The axle 502 not only extends entirely through elongated body, but also extends through the void 545 and middle aperture 524, thereby rigidly supporting both the elongated body of the hanger but also provides an axis of rotation for the arms 517 to rotate about. The combination of the rotation inhibiting structure 527 and the first rotation inhibiting protrusion 541 of the arm 517 forms an overlapping structure. When the truck 500 is in a zero-degree reference angle configuration, the overlapping structure will not be felt or apparent to the rider, however, as the arms 517 begins to rotate/pivot away from the ground surface, the first rotation inhibiting protrusion and the second rotation inhibiting protrusion will contact the pivot body 506 providing a physical barrier. This physical barrier prevents over rotation of the one or more arms to the point where the wheels 504 contact the bottom surface of the skateboard deck (not shown).

Figure 20:
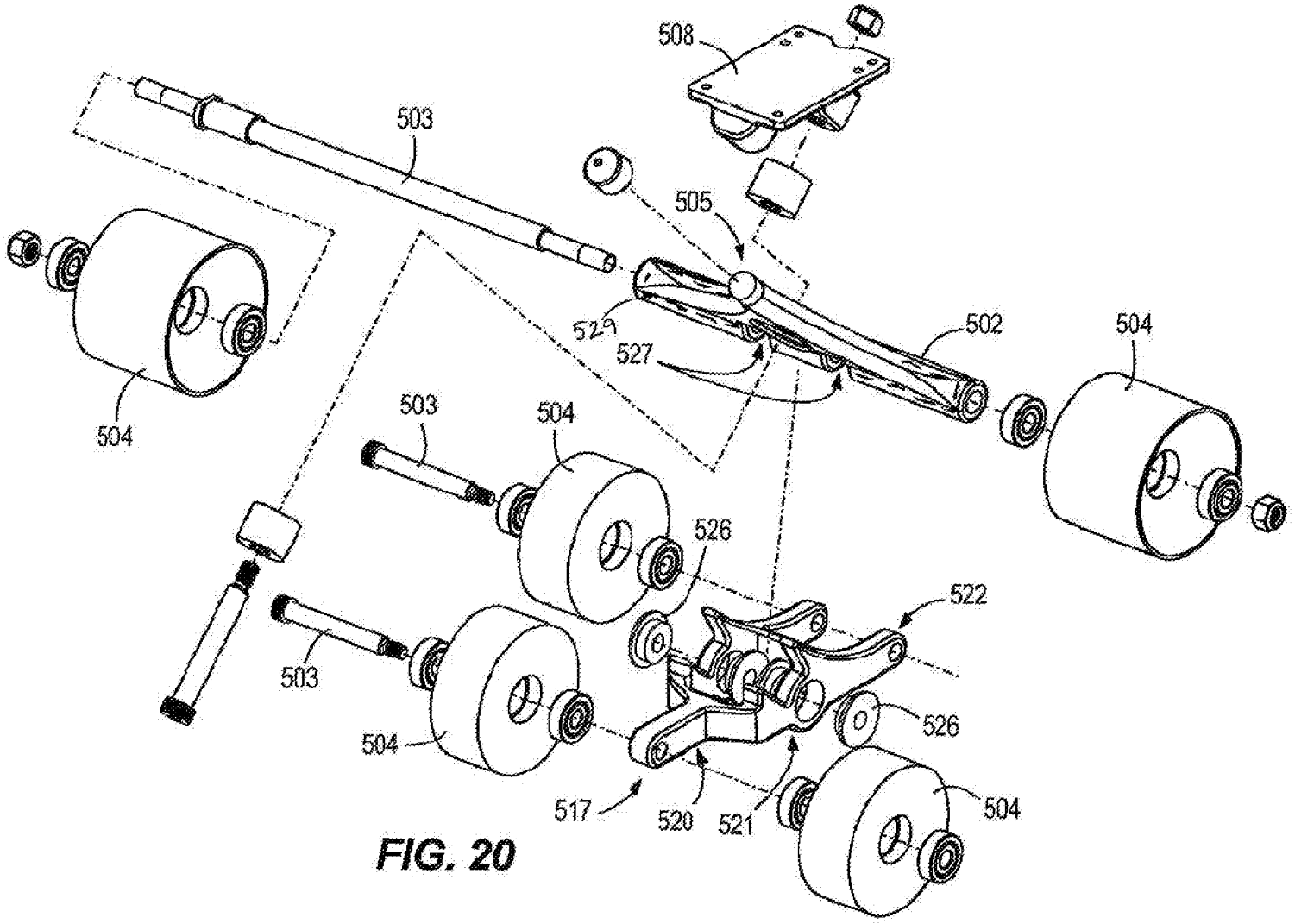
FIG. 20 shows an exploded view of the moving wheel platform of FIG. 15

FIG. 20 further illustrates that the front aperture 523 and the rear aperture 525 of each of the arm 517 is configured to receive at least one axles 503. Each axle 503 is configured to retain a wheel 504.

Referring again to FIGS. 14-20, the embodiment of the truck 500 further includes one or more friction reducing element 526 configured to be received within the two middle apertures 524 of the arm 517. In the case of this embodiment, each friction reducing element is defined by a first part and a second part. The first and second part of the friction reducing element is substantially flanged shape. The first and second part of the friction reducing element share similar elements. Referencing FIG. 19, the friction reducing element comprises a shoulder portion 548 and a body portion 549. In many embodiments, the body portion 549 is substantially cylindrical and comprises an inner diameter and an outer diameter. The shoulder portion extends radially outward from outer diameter at one end of the body portion. The first and second parts are mirror images of each other. The first and second friction reducing elements are press fit into opposing sides of the middle aperture 524. This type of structure and arrangement permits the friction reducing element to be positioned on opposing sides of the arm 517 to beneficially aid in aligning the middle aperture to the arm 517. This arrangement protects each side of the arm 517 from contacting the internal side walls of the rotation-inhibiting structures minimizing wear due to material galling or fatigue stresses.

With continued reference to FIGS. 14-20, the pivot body 506 and the pivot tip 507 forms a pivot saddle 505 that is substantially triangular. This type of triangular arrangement extends from the first end 530 of the elongated body 502 and the second end 531 of the elongated body 502, therefore additionally acting as a structural support mechanism to the elongated body 502, as stresses imposed on the hanger are distributed across a larger region and allowed to travel over a larger area.

As previously described, the base plate 508 is the component of the truck that couples the elongated body 502, the wheels 504, and the pivot saddle 505 to the skateboard deck 511. The base plate 508 forms a plurality of bolt receiving ports 509, at least one king pin receiving aperture 516, and at least one pivot cup receiving port 515. These receiving ports provides receiving geometries for a plurality of bolts, a king pin, and the pivot tip of the pivot saddle, respectively. Thereby, securing the moving wheel platform or the truck to a given apparatus.

The arrangement of the aforementioned truck components enables individuals riding skateboards or longboards to more efficiently maneuver over cracks in sidewalks as the configuration of the truck components enables the wheels coupled to the elongated body of the hanger to be suspended over a contraction joint (i.e. prevents the wheels from descending into the crack when the user is moving over a contraction joint). Further, this embodiment requires only one arm while still utilizing rotation-inhibiting structures and rotation inhibiting protrusions of the arms to prevents one or more wheels from contacting a bottom portion of the skateboard (i.e. preventing wheel bite). However, presents an alternative wheel arrangement configuration.

Example 1

Figure 21:
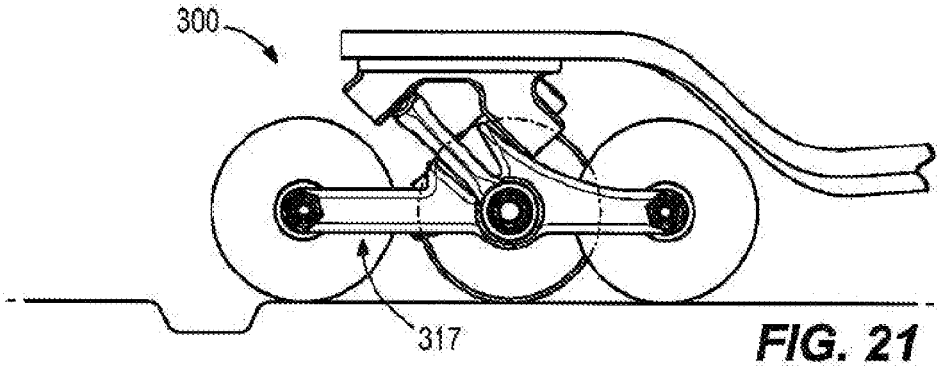
FIGS. 21-24 shows an exemplary motion analysis of the moving wheel platform of FIG. 8.
Figure 22:
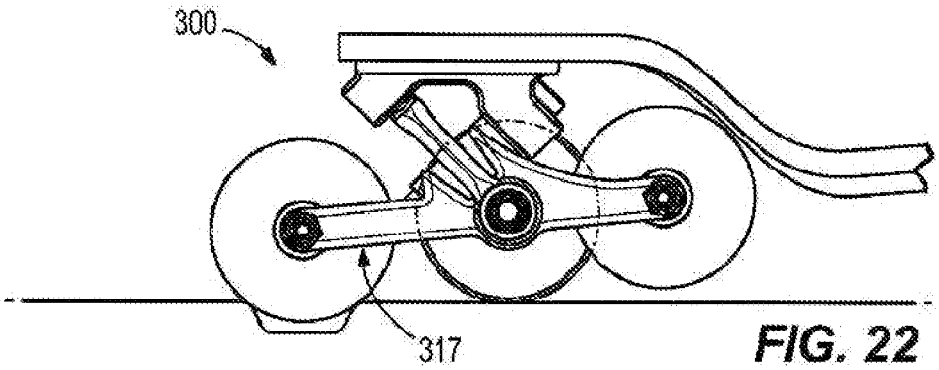
Figure 23:
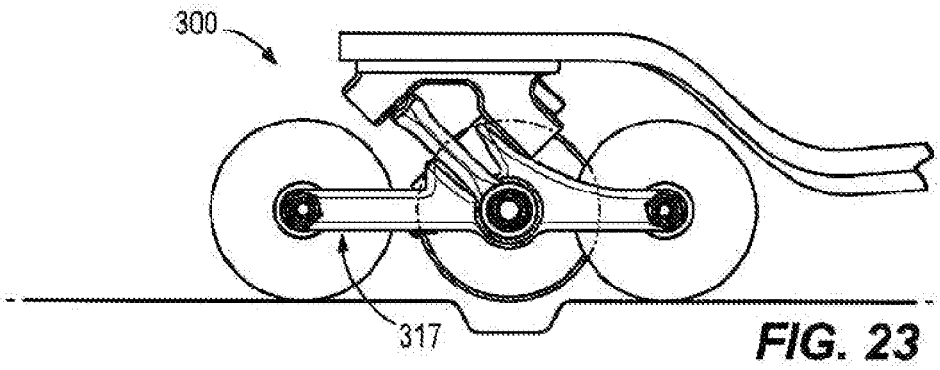
Figure 24:
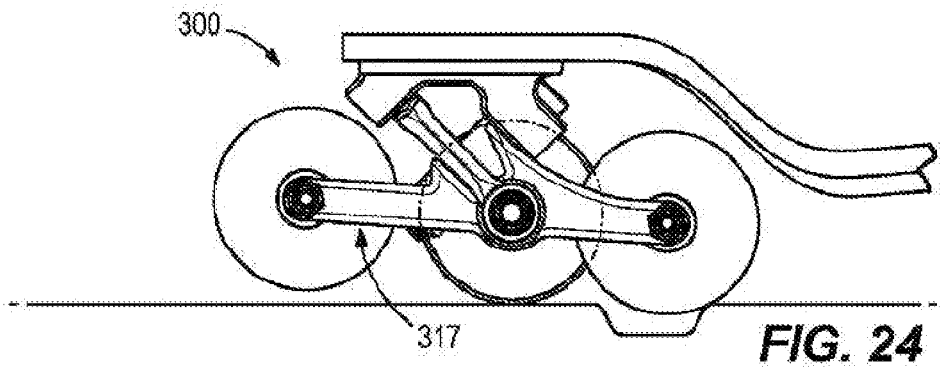

A high-speed motion analysis experiment was conducted to analyze the effectiveness of the skateboard truck embodiments to maneuver over sidewalk contraction joints of approximately 1.125 inches wide. Specifically, the embodiment of FIGS. 8-11 was analyzed. The truck is configured to have two or more wheels on the riding (or ground) surface at any given moment. This is in part caused by the length of the arms and wheel arrangement. FIG. 21 illustrates a user riding a skateboard approaching a crack (approximately 1.125 inches in width), at least two wheels engaged with the riding surface, and more particularly all four wheels. FIG. 22 illustrates the forward (or leading) wheel of the skateboard truck descending into the contraction joint and at least two wheels engaged with the riding surface, and more particularly three wheels. FIG. 23 illustrates the leading wheel ascending from the contraction joint onto an adjacent concrete slab, the two wheels attached to the axle that extends through the elongated body are suspended above the contraction joint, and the rear wheel (or trailing wheel) is on the opposing concreate slab. FIG. 24 illustrates the rear wheel (or trailing wheel) entering the contraction joint, however, as shown in all figures at least two wheels are always on the riding surface regardless of how the skateboard truck approaches the contraction joint. This either enables one or more wheels to glide over a contraction joint or minimize wheel interaction with the contraction joint.

Example 2

A high-speed motion analysis experiment was conducted to analyze the effectiveness of the skateboard truck embodiments to maneuver offer non-level, non-smooth, and uneven surfaces. Specifically, the embodiment of FIGS. 8-11 was analyzed. This study analyzed the velocity of the wheels before and after impact with an instantaneous change in the height of the riding (or ground) surface of 0.5 inch. Two versions of Skateboard Truck II were tested. The first version is in a standard arm ratio (i.e. the first segment of the arm and the second segment of the arm having an equivalent length of 3.5 inches). The second version is an increased arm ratio (i.e. the first segment of the arm is approximately 5 inches and the second segment of the arm is approximately 3.5 inches. Each version of the skateboard truck was analyzed with all wheels having a diameter of 69 mm or 75 mm. It was determined (1) that the velocity of the wheels in the standard arm ratio with wheel diameters of 69 mm decreased approximately 28% after impact with the instantaneous height change (2) that the velocity of the wheels in the standard arm ratio with wheel diameters of 75 mm decreased approximately 27.5% after impact with the instantaneous height change, (3) that the velocity of the wheels in the increased arm ratio with wheel diameters of 69 mm decreased approximately 28.8% after impact with the instantaneous height change, and (4) that the velocity of the wheels in the increased arm ratio with wheel diameters of 75 mm decreased approximately 30.5% after impact with the instantaneous height change. Therefore, both length of the arm (more particularly length of the first segment and second segment) and wheel diameter effect the wheel velocity after impact with a non-level, non-smooth, and/or uneven surface.

Various features and advantages of the disclosures are set forth in the following claims.

Clause 1. A truck comprising: a hanger; the hanger comprising: a cylindrical body; wherein the cylindrical body surrounds a bore or void; a pivot saddle; the pivot saddle further comprises a pivot tip and a pivot body surrounding an aperture; at least two rotation inhibiting structures; an axle; wherein the axle is received within the bore or the void of the cylindrical body of the hanger; an assembly; the assembly comprising: a first arm and a second arm; a first and second auxiliary wheels; wherein: the first and second arms comprises a front region, a middle region, and a rear region; the front region forms a front aperture; the middle region forms a middle aperture; the rear region forms a rear aperture; the two rotation inhibiting structures are adjacent and on opposing sides to the pivot saddle body and spaced from the cylindrical body; the two rotation inhibiting structures are coplanar to each other and/or wherein the middle region of the first and second arms are located in the space between the rotation inhibiting structure and the cylindrical body.

Clause 2. The truck of clause 1, wherein the first arm and the second arm comprises a first end and a second end, and wherein the first end and the second end are substantially planar to one another or at an angle between 178 degrees and 180 degrees.

Clause 3. The truck of clause 1, wherein the first arm and the second arm comprises a first end and a second end, and wherein the first end and the second end are at an angle between 178 degrees and 180 degrees.

Clause 4. The truck of clause 1, wherein the truck is in the nose of a skateboard.

Clause 5. The truck of clause 4, wherein the truck is in the tail of a skateboard.

Clause 6. The truck of clause 1, wherein a third wheel and a fourth wheel are coupled to the axle.

Clause 7. The truck of clause 1, wherein the first wheel, the second wheel, the third wheel and the fourth wheel are in a diamond-shape configuration.

Clause 8. The truck of clause 2, wherein the first end of the first and second arms are shorter in length than the second end of the first and second arms.

Clause 9. The truck of clause 6, wherein the first wheel, the second wheel, the third wheel, and the fourth wheel are the same diameter.

Clause 10. The truck of clause 1, wherein the rotation-inhibiting structure defines a predetermined range of movement.

Clause 11. The truck of clause 10, wherein the predetermined range of movement is between 0 degrees and 35 degrees.

Clause 12. The truck of clause 1, wherein a length of the rotation inhibiting structure is non-circular nor elliptical with a length between 2 to 2.5 inches.

Clause 13. The truck of clause 12, wherein a width of the rotation inhibiting structure is between 0.125 inch and 0.375 inch.

Clause 14. The truck of clause 1, wherein the truck further comprises one or more flange bearings that are housed within the middle aperture of the first and second arms to reduce frictional forces between the cylindrical body of the hanger and the first and second arms.

Clause 15. The truck of clause 14, wherein the flange bearing is comprised of a nylon material.

Clause 16. The truck of clause 3, wherein the truck is in a reverse king pin configuration.

Clause 17. The truck of clause 1, wherein the front aperture, the middle aperture, and the rear aperture are circular.

Clause 18. The truck of clause 1, wherein the rotation-inhibiting structure is solid.

Clause 19. The truck of clause 1, wherein the rotation-inhibiting structure is hollow.

Clause 20. The truck of clause 6, wherein the diameter of the first wheel, the second wheel, the third wheel, and the fourth wheel are between 3 and 6 inches.

What is claimed is:

1. A truck comprising:

a hanger; the hanger comprising:

an elongated body comprising a first end and a second end distal the first end;

a void formed at the first end; wherein the elongated body surrounds the void at the first end;

a pivot saddle; the pivot saddle further comprises a pivot tip and a pivot body surrounding an aperture;

an axle coupled to the hanger and received within the void;

a central wheel affixed to the axle;

an arm rotatably coupled to the elongated body, the arm comprising:

a front region forming a front aperture;

a middle region forming a middle aperture;

a rear region forming a rear aperture;

wherein the axle extends through the middle aperture of the arm;

wherein the axle provides an axis of rotation for the arm;

a front axle received by the front aperture;

a front wheel coupled to the front axle;

a rear axle received by the rear aperture;

a rear wheel coupled to the rear axle;

wherein the hanger forms a rotation inhibiting structure protruding towards the first end of the elongated body.

2. The truck of claim 1, wherein the arm comprises a first end and a second end, and wherein the first end and the second end are substantially planar to one another.

3. The truck of claim 1, wherein the truck is in a nose of a skateboard.

4. The truck of claim 1, wherein the truck is in a tail of a skateboard.

5. The truck of claim 1, wherein the central wheel, the front wheel, the rear wheel comprise equal diameters.

6. The truck of claim 5, wherein the diameter of the central wheel, the front wheel, the rear wheel is between 2.7 and 4 inches.

7. The truck of claim 1, wherein the rotation inhibiting structure defines a predetermined rotational range of movement for the arm.

8. The truck of claim 7, wherein the predetermined rotational range of movement is between 0 degrees and 35 degrees.

9. The truck of claim 1, wherein the truck further comprises one or more flange bearings that are housed within the middle aperture of the arm to reduce frictional forces between the elongated body of the hanger and the arm.

10. The truck of claim 9, wherein the one or more flange bearings are comprised of a nylon material.

11. The truck of claim 1, wherein the truck is in a reverse king pin configuration.

12. The truck of claim 1, wherein the front aperture, the middle aperture, and the rear aperture are circular.

13. The truck of claim 1, wherein the rotation inhibiting structure is solid.

14. The truck of claim 1, wherein the rotation inhibiting structure is hollow.

15. A truck comprising:

a hanger; the hanger comprising:

an elongated body comprising a first end and a second end distal the first end;

a void formed at the first end, wherein the elongated body surrounds the void at the first end;

a pivot saddle; the pivot saddle further comprises a pivot tip and a pivot body surrounding an aperture;

an axle coupled to the hanger and received within the void;

a central wheel affixed to the axle;

an arm rotatably coupled to the elongated body, the arm comprising:

a front region forming a front aperture;

a middle region forming a middle aperture;

a rear region forming a rear aperture;

wherein the axle extends through the middle aperture of the arm;

wherein the axle provides an axis of rotation for the arm;

a front axle received by the front aperture;

a front wheel coupled to the front axle;

a rear axle received by the rear aperture;

a rear wheel coupled to the rear axle;

wherein the elongated body forms a rotation inhibiting structure in the form of a notch; and wherein the arm comprises a rotation inhibiting protrusion configured to be received within the notch of the rotation inhibiting structure.

16. The truck of claim 15, wherein the hanger is configured to couple to a bottom surface of a skateboard deck.

17. The truck of claim 16, wherein a rotation of the arm decreases a perpendicular distance between one of the front wheel and the rear wheel the a bottom surface of the skateboard deck.

18. The truck of claim 16, wherein the rotation inhibiting structure prevents the front wheel and the rear wheel from contacting the bottom surface of the skateboard deck.

19. The truck of claim 15, wherein the rotation inhibiting structure defines a predetermined rotational range of movement for the arm.

20. The truck of claim 19, wherein the predetermined rotational range of movement is between 0 degrees and 35 degrees.

* * * * *